US012000389B2

(12) United States Patent
Fujisaki

(10) Patent No.: US 12,000,389 B2
(45) Date of Patent: Jun. 4, 2024

(54) GAS CONTROL DEVICE

(71) Applicant: Murata Manufacturing Co., Ltd., Kyoto (JP)

(72) Inventor: Masaaki Fujisaki, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 17/805,085

(22) Filed: Jun. 2, 2022

(65) Prior Publication Data

US 2022/0290665 A1 Sep. 15, 2022

Related U.S. Application Data

(60) Division of application No. 16/050,190, filed on Jul. 31, 2018, now Pat. No. 11,378,071, which is a (Continued)

(30) Foreign Application Priority Data

Feb. 1, 2016 (JP) ..... 2016-016952

(51) Int. Cl.
*F04B 45/047* (2006.01)
*F04B 39/12* (2006.01)
*F04B 41/06* (2006.01)

(52) U.S. Cl.
CPC ..... *F04B 45/047* (2013.01); *F04B 39/12* (2013.01); *F04B 41/06* (2013.01)

(58) Field of Classification Search
CPC ..... F04B 43/06; F04B 43/043; F04B 43/046; F04B 45/04; F04B 45/041; F04B 45/043; F04B 45/047
See application file for complete search history.

(56) References Cited

U.S. PATENT DOCUMENTS 3,657,930 A 4/1972 Jacobson
4,098,308 A 7/1978 Purdum
(Continued)

FOREIGN PATENT DOCUMENTS

JP S61-130784 U1 8/1986
JP H06-147666 A 5/1994
(Continued)

OTHER PUBLICATIONS

International Search Report for PCT/JP2017/003269 dated Mar. 28, 2017.
Written Opinion for PCT/JP2017/003269 dated Mar. 28, 2017.

*Primary Examiner* — Thomas Fink
(74) *Attorney, Agent, or Firm* — Pearne & Gordon LLP

(57) ABSTRACT

A gas control device includes a first pump, a second pump, and a connection casing. The first pump includes a first pump casing, a first suction hole, and a first discharge hole. The first pump casing has a plurality of outer walls. The second pump includes a second pump casing, a second suction hole, and a second discharge hole. The connection casing has a first opening and a second opening. The connection casing forms, together with the first pump casing and the second pump casing, a first closed space. The second discharge hole and the first suction hole communicate with each other via the first closed space. The first pump and the second pump are connected in series with each other. The outer wall in which first suction hole is provided faces the first closed space.

6 Claims, 24 Drawing Sheets

Related U.S. Application Data continuation of application No. PCT/JP2017/003269, filed on Jan. 31, 2017.

(56) References Cited

U.S. PATENT DOCUMENTS

| | | | | |
|---|---|---|---|---|
| 6,877,488 | B2 | 4/2005 | Washeleski et al. | |
| 11,293,429 | B2 * | 4/2022 | Okaguchi | F04B 17/003 |
| 2006/0147325 | A1 | 7/2006 | Vogeley | |
| 2009/0148320 | A1 | 6/2009 | Lucas | |
| 2011/0280755 | A1 | 11/2011 | Wackerle et al. | |
| 2012/0171062 | A1 | 7/2012 | Kodama et al. | |
| 2012/0301333 | A1 | 11/2012 | Smirnov | |
| 2015/0059749 | A1 * | 3/2015 | Nitta | A61M 16/0063 128/204.18 |
| 2015/0267695 | A1 | 9/2015 | Marsh | |
| 2016/0010636 | A1 | 1/2016 | Tanaka et al. | |
| 2017/0215744 | A1 | 8/2017 | Kawamura | |
| 2019/0085836 | A1 | 3/2019 | Mou et al. | |

FOREIGN PATENT DOCUMENTS

| | | | |
|---|---|---|---|
| JP | H07-301182 | A | 11/1995 |
| JP | 2004-169706 | A | 6/2004 |

* cited by examiner

GAS CONTROL DEVICE

This is a division of U.S. patent application Ser. No. 16/050,190 filed on Jul. 31, 2018, which is a continuation of International Application No. PCT/JP2017/003269 filed on Jan. 31, 2017 which claims priority from Japanese Patent Application No. 2016-016952 filed on Feb. 1, 2016. The contents of these applications are incorporated herein by reference in their entireties.

BACKGROUND OF THE DISCLOSURE

Field of the Disclosure

The present disclosure relates to a gas control device that transports a gas.

Description of the Related Art

Heretofore, gas control devices that transport gases have been widely used. For example, Patent Document 1 discloses a fluid transporting system 900 that transports air.

FIG. 22 is a plan view of the fluid transporting system 900 disclosed in Patent Document 1. FIG. 23 is a sectional view illustrating a case where the fluid transporting system 900 illustrated in FIG. 22 is discharging air. The fluid transporting system 900 includes flow passages 931, 933, and 935, and two pumps 910 and 920. The pumps 910 and 920 have the same configuration as each other. The two pumps 910 and 920 of the fluid transporting system 900 are connected in series with each other. The flow passage 935 is connected to a container, for example.

In the above-described configuration, as illustrated in FIG. 23, when the two pumps 910 and 920 are discharging air, the air flows from the flow passage 931 to the flow passage 935 via the flow passage 933 and then flows into the container. Consequently, the pressure inside the container increases. In contrast, when the two pumps 910 and 920 are sucking air, the air inside the container flows from the flow passage 935 to the flow passage 931 via the flow passage 933. Consequently, the pressure inside the container decreases.

In this case, the maximum discharge flow rate produced by the two serially connected pumps 910 and 920 is the same as the maximum discharge flow rate produced by the one pump 910. On the other hand, the maximum discharge pressure produced by the two serially connected pumps 910 and 920 is twice the maximum discharge pressure produced by the one pump 910. For example, as illustrated in FIG. 23, the pumps 910 and 920 each produce a discharge pressure P1, and therefore the maximum discharge pressure produced by the two serially connected pumps 910 and 920 is 2× P1.

Patent Document 1: Japanese Unexamined Patent Application Publication No. 2004-169706

BRIEF SUMMARY OF THE DISCLOSURE

However, in the case where a plurality of pumps are connected in series with each other, the difference between the pressure inside a pump casing and the outside pressure is increased in a pump that is connected on a low-stage side close to the container. For example, as illustrated in FIG. 23, a pressure difference ΔP between a pressure P1+P0 inside a pump casing of the pump 920 on the high-stage side and an outside pressure P0 (atmospheric pressure) is equal to P1, whereas a pressure difference ΔP between a pressure 2× P1+P0 inside a pump casing of the pump 910 on the low-stage side close to the container and the outside pressure P0 (atmospheric pressure) is equal to 2× P1.

Consequently, a pump casing 902 of the pump 910 connected on the low-stage side is more easily deformed than a pump casing 902 of the pump 920 connected on the high-stage side. Therefore, it is possible that the pump casing 902 of the pump 910 connected on the low-stage side will become damaged.

Accordingly, a method has been considered in which the thickness of the pump casing 902 of the pump 910 is increased in order to increase the pressure resistance thereof, but there is a problem in that the size and the weight of the pump 910 are increased with this method.

In particular, convenience is reduced when the size of a pump is increased for devices that are required to be portable such as a wrist-mounted blood pressure sensor or in negative pressure wound therapy (NPWT).

An object of the present disclosure is to provide a gas control device that can prevent a pump that is connected on a low-stage side from becoming damaged even in the case where a plurality of pumps are connected in series with each other.

(1) A gas control device of the present disclosure includes:

a first pump that includes a first pump casing having a plurality of outer walls and a first suction hole and a first discharge hole that are provided in the first pump casing;

a second pump that includes a second pump casing and a second suction hole and a second discharge hole that are provided in the second pump casing; and a connection casing that forms, together with the first pump casing and the second pump casing, a first closed space.

Among the plurality of outer walls, at least a first outer wall, in which the first suction hole is provided, faces the first closed space, and the second discharge hole and the first suction hole communicate with each other via the first closed space.

In this configuration, the first discharge hole is connected to a container, for example.

(2) A gas control device of the present disclosure includes:

a first pump that includes a first pump casing having a plurality of outer walls and a first suction hole and a first discharge hole that are provided in the first pump casing;

a second pump that includes a second pump casing and a second suction hole and a second discharge hole that are provided in the second pump casing; and a connection casing that forms, together with the first pump casing and the second pump casing, a first closed space.

Among the plurality of outer walls, at least a first outer wall, in which the first discharge hole is provided, faces the first closed space, and the first discharge hole and the second suction hole communicate with each other via the first closed space.

In this configuration, the first suction hole is connected to a container, for example.

(3) In the gas control device having the configuration described in (1) or (2) above, the first pump and the second pump are connected in series with each other by the connection casing. At least the first outer wall among the plurality of outer walls faces the first closed space.

Therefore, the gas control device is able to suppress a pressure difference ΔP between the pressure on the inner side of the first outer wall of the first pump casing of the first pump on the low stage side that is close to a container and the outside pressure down to a discharge pressure P1 of the first pump.

Therefore, the gas control device is able to prevent the first pump, which is connected on the low stage side, from becoming damaged even in the case where a plurality of pumps are connected in series with each other. In addition, there is no need to increase the thickness of the first outer wall in order to increase the pressure resistance of the gas control device. Therefore, there is no need to increase the size or weight of the first pump in the gas control device.

Here, it is preferable that the pumps in the present disclosure be optimally designed in accordance with the loads of the pumps. "The load of a pump" refers to the pressure acting on the pump or the density of a fluid passing therethrough. Specifically, in the case of a rotary pump, the pump is preferably designed so as to operate with a lower torque and a higher revolution speed as the fluid density decreases and so as to operate with a higher torque and a lower revolution speed as the fluid density increases. On the other hand, in the case of a diaphragm pump, the pump is preferably designed so as to operate with a higher amplitude and a lower inertia as the fluid density decreases and so as to operate with a lower amplitude and a higher inertia as the fluid density increases. The fluid pressure can be effectively increased by designing the pumps in this way.

In addition, it is preferable that the connection casing have higher rigidity. This is in order to suppress the deformation of the casing as the pressure increases.

In addition, it is preferable that a pump casing that does not face a closed space be formed of substantially the same member. This is because it is often the case that a part of a pump casing that has a low withstand pressure is a joint part between the constituent members of the pump casing, and when such a joint part faces a closed space, the deformation starts from the joint part and the cracking occurs.

The present disclosure can prevent a pump that is connected on a low stage side from becoming damaged even in the case where a plurality of pumps are connected in series with each other.

DETAILED DESCRIPTION OF THE DISCLOSURE

Hereafter, a gas control device according to a first embodiment of the present disclosure will be described.

Figure 1:
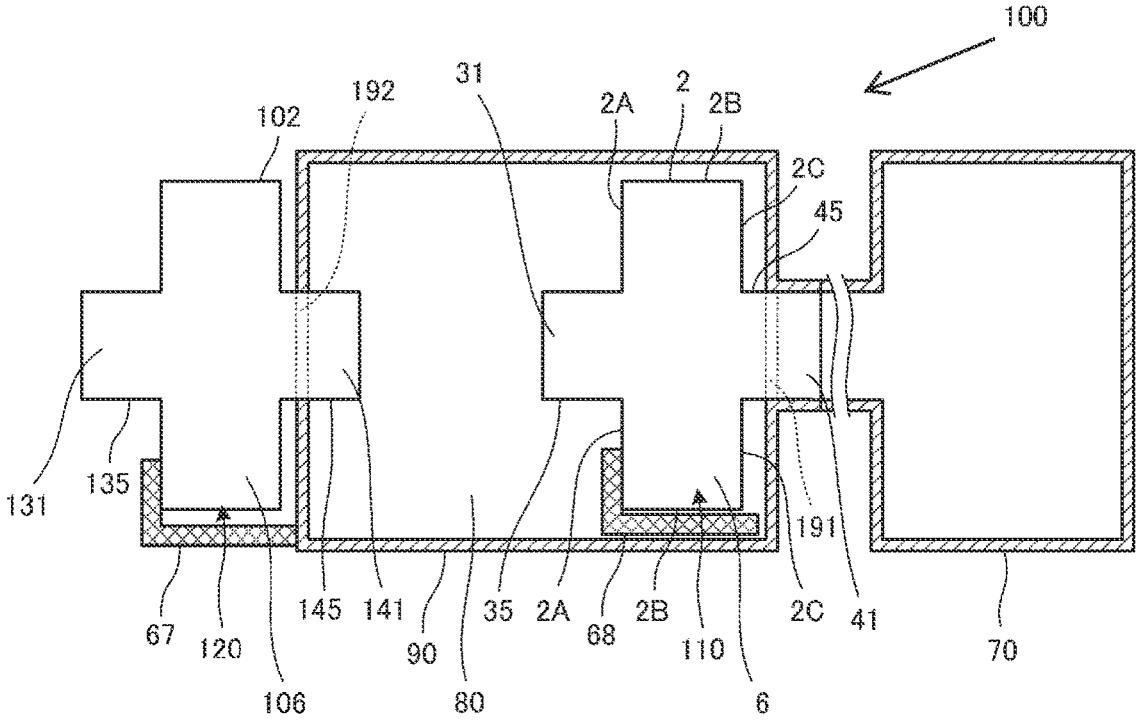
FIG. 1 is a schematic sectional view of a gas control device 100 according to a first embodiment of the present disclosure.

FIG. 1 is a schematic sectional view of a gas control device 100 according to a first embodiment of the present disclosure. The gas control device 100 includes a first pump 110, a second pump 120, and a connection casing 90.

The first pump 110 has a first pump casing 2, a first suction hole 31 and a first discharge hole 41 provided in the first pump casing 2, a first nozzle 45 inside of which the first discharge hole 41 is formed, and a first nozzle 35 inside of which the first suction hole 31 is formed. The first pump casing 2 has a plurality of outer walls 2A, 2B, and 2C. In addition, in this embodiment, the outer wall 2A corresponds to an example of a first outer wall of the present disclosure, and the outer walls 2B and 2C correspond to the examples of the second outer walls of the present disclosure.

The second pump 120 has a second pump casing 102, a second suction hole 131 and a second discharge hole 141 provided in the second pump casing 102, a second nozzle 145 inside of which the second discharge hole 141 is formed, and a second nozzle 135 inside of which the second suction hole 131 is formed.

The connection casing 90 has a first opening 191, a second opening 192, a wiring line 67, and a wiring line 68. The first nozzle 45 is fitted into the first opening 191 of the connection casing 90 and the first pump casing 2 is thereby fixed in place by the connection casing 90. As a result, the connection casing 90 contacts the first pump 110 only at the first nozzle 45. Therefore, the connection casing 90 does not obstruct the vibration of the first pump 110. Therefore, the characteristics of the first pump 110 can be maintained.

The wiring line 68 is connected to a power supply, which is not illustrated, and is connected to external connection terminals 3A and 4A of the first pump 110, which will be described later.

In addition, the second nozzle 145 is fitted into the second opening 192 of the connection casing 90 and the second pump casing 102 is thereby fixed in place by the connection casing 90. Thus, the connection casing 90 contacts the second pump 120 only at the second nozzle 145. Therefore, the connection casing 90 does not obstruct the vibration of the second pump 120. Therefore, the characteristics of the second pump 120 can be maintained.

The wiring line 67 is connected to a power supply, which is not illustrated, and is connected to external connection terminals 3A and 4A of the second pump 120, which will be described later.

The connection casing 90 forms, together with the first pump casing 2 of the first pump 110 and the second pump casing 102 of the second pump 120, a first closed space 80. The second discharge hole 141 and the first suction hole 31 communicate with each other via the first closed space 80. Thus, the first pump 110 and the second pump 120 are connected in series with each other. In addition, the first discharge hole 41 communicates with the inside of a container 70. The second suction hole 131 is open to the atmosphere.

In this case, regarding the first pump 110, the part of the first pump casing 2 other than the first nozzle 45 faces the first closed space 80. In other words, at least the outer wall 2A among the plurality of outer walls 2A, 2B, and 2C faces the first closed space 80. In addition, the outer walls 2B and 2C, other than the outer wall 2A, among the plurality of outer walls 2A, 2B, and 2C also face the first closed space 80.

Next, an example of a specific configuration of the gas control device 100 will be described.

Figure 2:
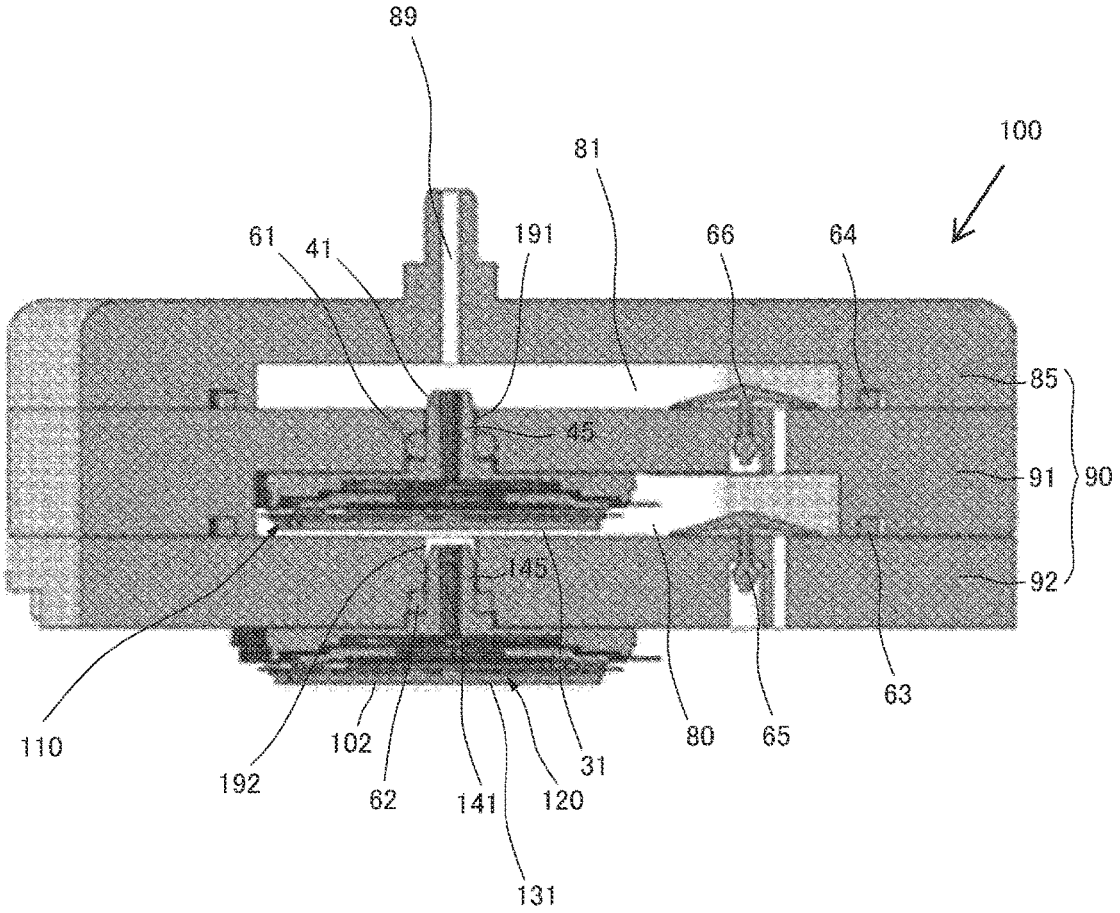
FIG. 2 is a sectional view of the gas control device 100 illustrated in FIG. 1.
Figure 3:
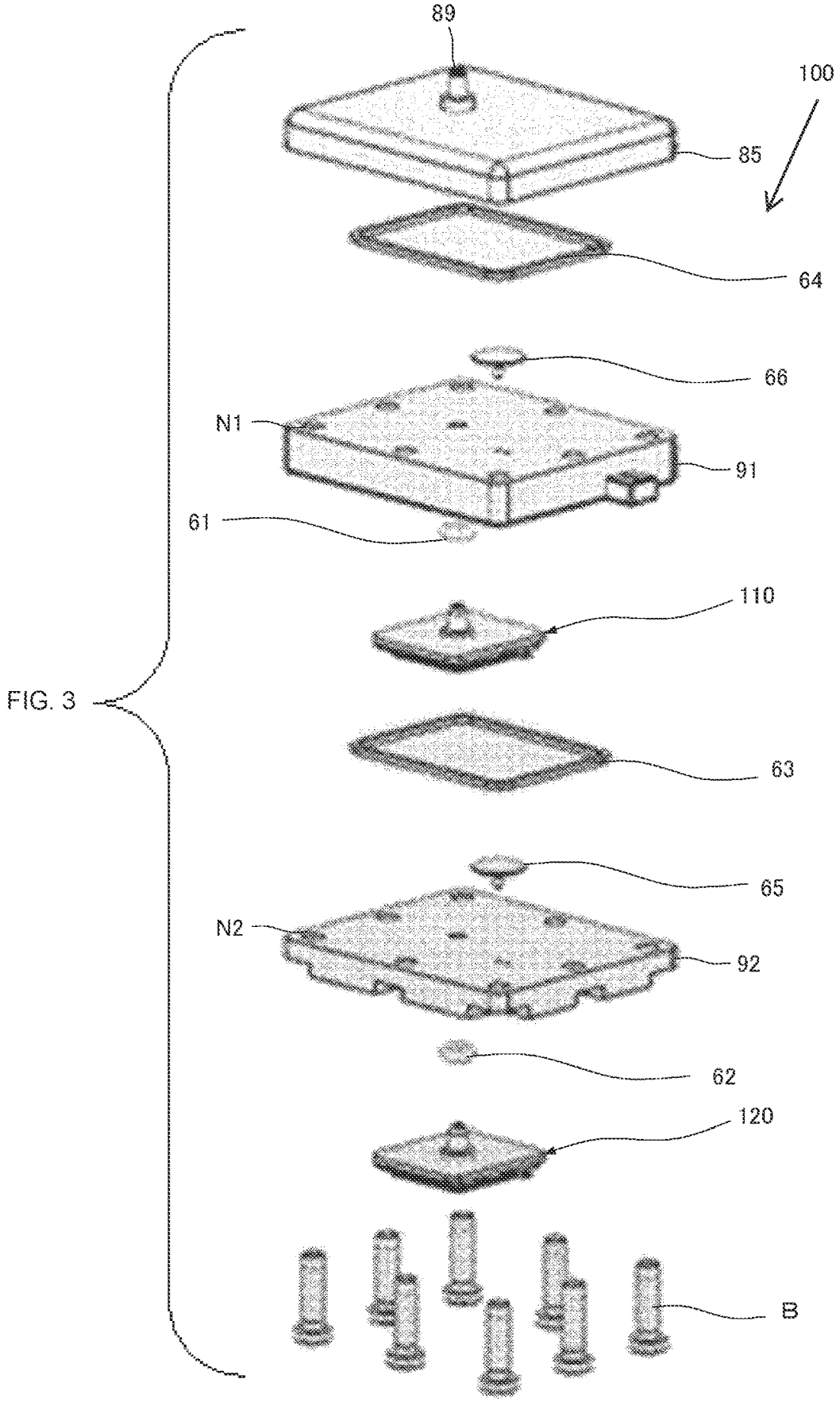
FIG. 3 is an exploded perspective view of the gas control device 100 illustrated in FIG. 1.
Figure 4:
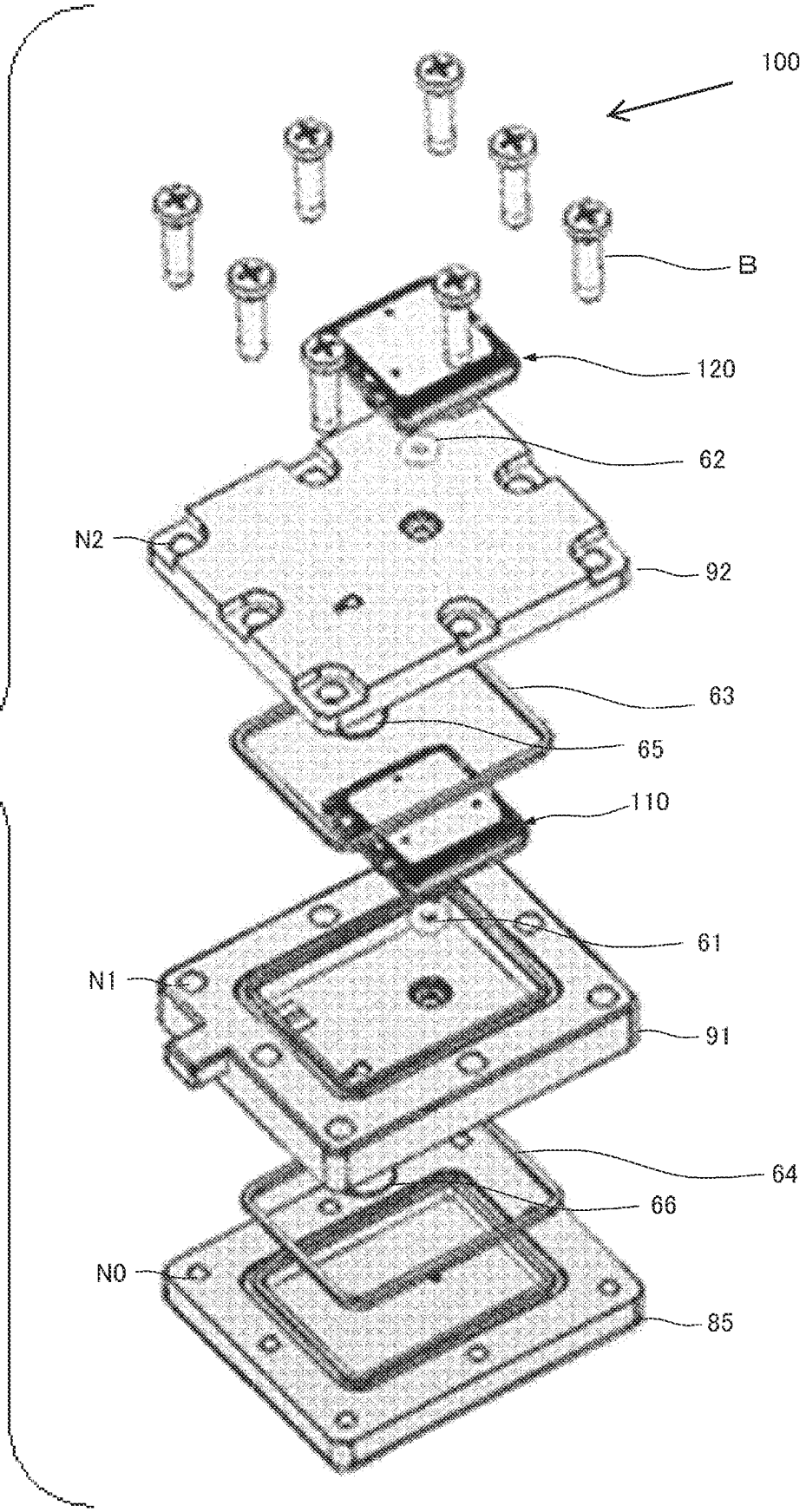
FIG. 4 is an exploded perspective view of the gas control device 100 illustrated in FIG. 1.

FIG. 2 is a sectional view of the gas control device 100 illustrated in FIG. 1. FIG. 3 is an exploded perspective view of the gas control device 100 illustrated in FIG. 1 as seen from above. FIG. 4 is an exploded perspective view of the gas control device 100 illustrated in FIG. 1 as seen from below.

The connection casing 90 has a structure in which a lid casing 85, a first casing 91, and a second casing 92 are stacked on top of one another with packing 63 and packing 64 interposed therebetween. The lid casing 85 has eight bolt holes N0. The first casing 91 has eight bolt holes N1. The second casing 92 has eight bolt holes N2. Eight bolts B are inserted into the bolt holes N0, N1, and N2, and thereby the lid casing 85, the first casing 91, and the second casing 92 are joined to one another. The lid casing 85 has a connection hole 89 that communicates with the inside of the container 70. The first casing 91 has the first opening 191. The second casing 92 has the second opening 192.

The lid casing 85 and the first casing 91 form a closed space 81 that communicates with the connection hole 89 and the first discharge hole 41.

The first nozzle 45 is fitted into the first opening 191 of the first casing 91 with an O ring 61 interposed therebetween, and thereby the first pump casing 2 is fixed in place by the 1st casing 91. As a result, the first discharge hole 41 communicates with the inside of the container 70.

The second nozzle 145 is fitted into the second opening 192 of the second casing 92 with an O ring 62 interposed therebetween, and thereby the second pump casing 102 is fixed in place by the 2nd casing 92. The second suction hole 131 is open to the atmosphere.

In addition, a non-return valve 66 is provided in the first casing 91. Furthermore, a non-return valve 65 is provided in the second casing 92. In the case where either the first pump 110 or the second pump 120 breaks down in a blocked state, the non-return valve 65 or the non-return valve 66, which is connected in parallel with the broken down pump, opens and air passes the broken down pump. Therefore, the non-return valve 65 and the non-return valve 66 can prevent a discharge pressure or a suction pressure of 0 kPa from occurring in the gas control device 100.

The first casing 91 and the second casing 92 in the above-described configuration form the first closed space 80 together with the first pump casing 2 and the second pump casing 102. The second discharge hole 141 and the first suction hole 31 communicate with each other via the first closed space 80.

In addition, although the connection casing 90 has the non-return valve 65 and the non-return valve 66 in this embodiment, the connection casing 90 is not limited to this configuration. At the time of implementation, the connection casing 90 does not need to have the non-return valve 65 and the non-return valve 66.

Next, an example of a specific configuration of the first pump 110 will be described. The configuration of the second pump 120 in this embodiment is the same as the configuration of the first pump 110. In other words, the configurations of the second pump casing 102, the second suction hole 131, the second discharge hole 141, the second nozzle 135, and the second nozzle 145 of the second pump 120 are the same as the configurations of the first pump casing 2, the first suction hole 31, the first discharge hole 41, the first nozzle 35, and the first nozzle 45 of the first pump 110, respectively. Therefore, the description of the configuration of the second pump 120 will be omitted.

Figure 5:
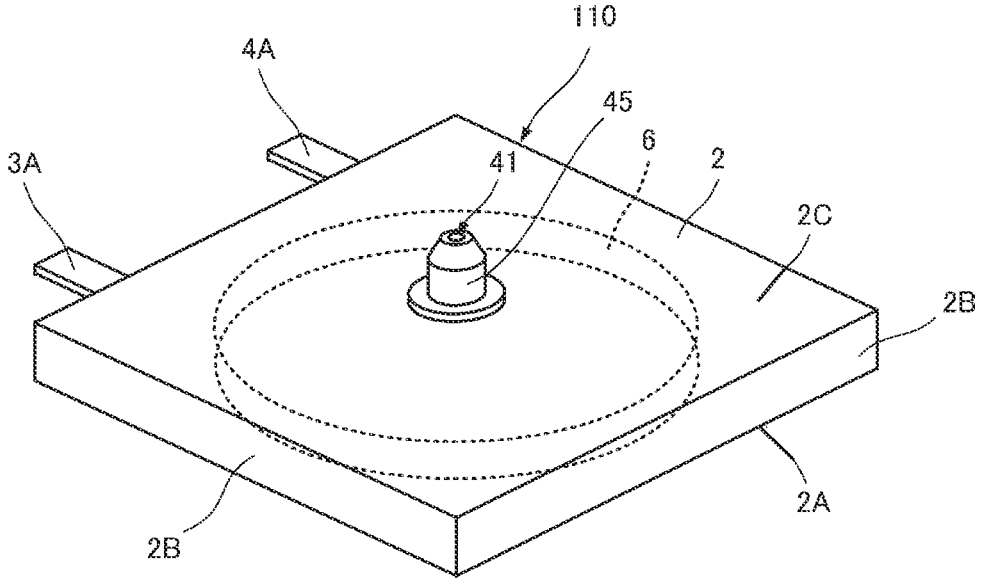
FIG. 5 is an external perspective view of a first pump 110 illustrated in FIG. 1.

FIG. 5 is an external perspective view of the first pump 110 illustrated in FIG. 1.

The first pump 110 includes the first pump casing 2 and the external connection terminals 3A and 4A. The external connection terminals 3A and 4A are connected to an external power supply and an alternating-current driving signal is applied thereto. The first pump casing 2 has a rectangular parallelepiped shape, and includes one outer wall 2A in which the first suction hole 31 is provided, one outer wall 2C in which the first discharge hole 41 is provided, and four outer walls 2B, in addition to the outer wall 2A and the outer wall 2C.

In addition, the first pump casing 2 forms, inside thereof, a pump chamber 6. The first pump casing 2 includes the first discharge hole 41, which communicates with the pump chamber 6, and first suction holes 31 (refer to FIG. 6), which communicate with the pump chamber 6.

Figure 6:
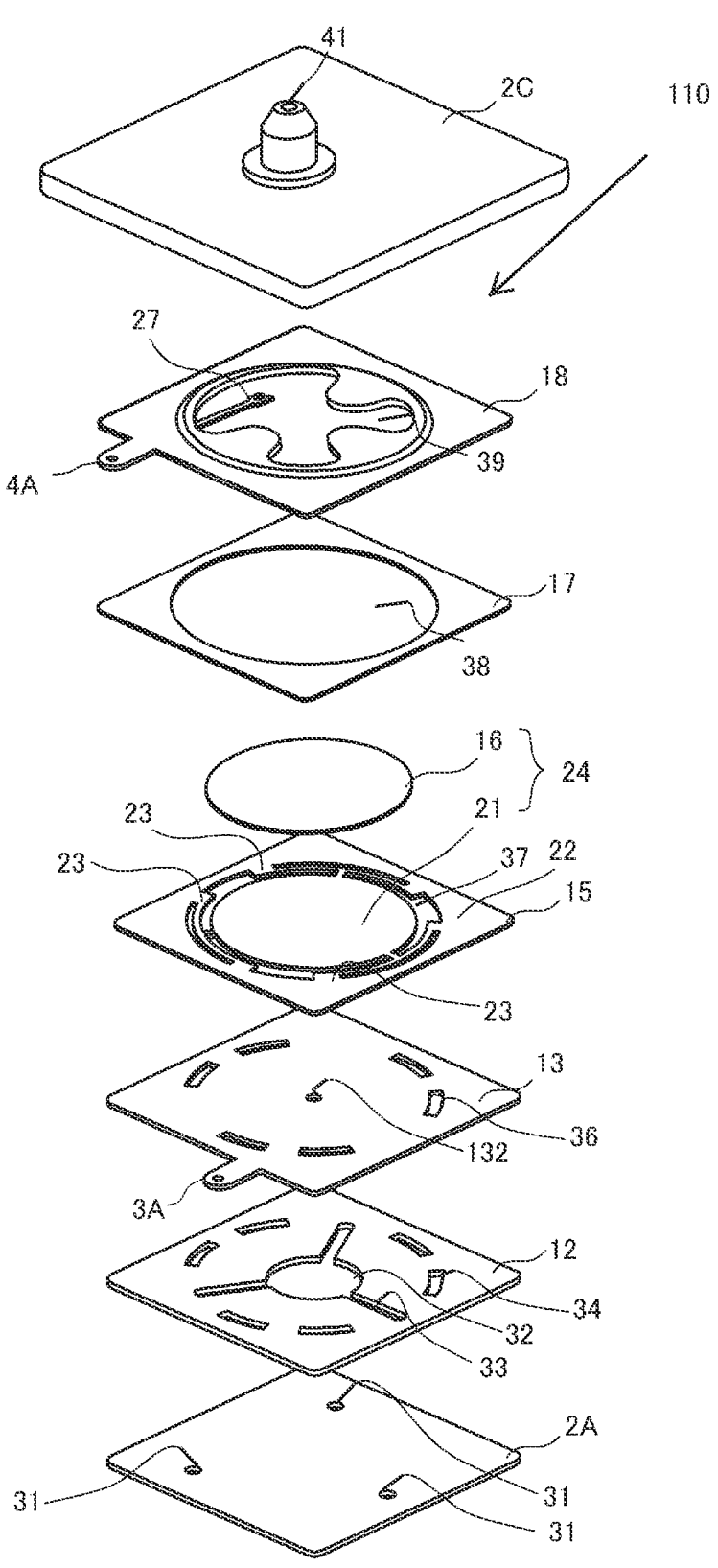
FIG. 6 is an exploded perspective view of the first pump 110 illustrated in FIG. 1.

FIG. 6 is an exploded perspective view of the first pump 110 illustrated in FIG. 1. The first pump 110 includes the outer wall 2A, a flow passage plate 12, a counter plate 13, a vibration plate 15, a piezoelectric element 16, an insulating plate 17, a power feeding plate 18, and the outer wall 2C, and has a structure in which these components are stacked in this order.

The outer wall 2A is plate shaped and has three first suction holes 31. Flow passages that communicate with the three first suction holes 31 and the pump chamber 6 are formed in the flow passage plate 12 and the counter plate 13. The vibration plate 15, the insulating plate 17, and the power feeding plate 18 form the pump chamber 6 (refer to FIG. 5). The first discharge hole 41, which communicates with the pump chamber 6, is formed in the outer wall 2C.

The flow passage plate 12 includes one opening 32, three flow passages 33, and six adhesive sealing holes 34. The opening 32 is provided at a position in the center of the flow passage plate 12. The lower surface side of the opening 32 is covered by the outer wall 2A and the upper surface side of the opening 32 communicates with a flow passage hole 132 of the counter plate 13, which will be described later.

The three flow passages 33 extend radially from the opening 32 provided close to the center of the flow passage plate 12. A first end of each flow passage 33 communicates with the opening 32. A second end of each flow passage 33 communicates with a corresponding one of the three first suction holes 31 in the outer wall 2A. The upper surface sides and lower surface sides of the flow passages 33 are covered by the outer wall 2A and the counter plate 13 except for at the second ends thereof.

The six adhesive sealing holes 34 communicate with the pump chamber 6. The adhesive sealing holes 34 are arranged so as to be spaced apart from one another along the outer periphery of the pump chamber 6 (refer to FIG. 5). The lower surface sides of the adhesive sealing holes 34 are covered by the outer wall 2A and the upper surface sides of the adhesive sealing holes 34 communicate with adhesive sealing holes 36 in the counter plate 13, which will be described later.

The counter plate 13 is composed of a metal and includes the external connection terminal 3A that protrudes toward the outside. Furthermore, the counter plate 13 includes one flow passage hole 132 and six adhesive sealing holes 36.

The flow passage hole 132 is provided in the center of the counter plate 13 so as to have a smaller diameter than the opening 32 in the flow passage plate 12. The lower surface side of the flow passage hole 132 communicates with the opening 32 in the flow passage plate 12 and the upper surface side of the flow passage hole 132 communicates with the pump chamber 6 (refer to FIG. 5).

The six adhesive sealing holes 36 are arranged so as to be spaced apart from one another along the outer periphery of the pump chamber 6 (refer to FIG. 5). The adhesive sealing holes 36 communicate with the adhesive sealing holes 34 in the flow passage plate 12.

The adhesive sealing holes 34 and 36 are holes into which an adhesive in an uncured state flows when the counter plate 13 and the vibration plate 15 are bonded to each other. The adhesive sealing holes 34 and 36 prevent an uncured adhesive from protruding into the pump chamber 6 (refer to FIG. 5) and adhering to the connection portions 23 of the vibration plate 15.

The vibration plate 15, which is a first vibration plate (or a second vibration plate), is composed of a metal such as stainless steel. The vibration plate 15 includes a circular plate portion 21, a frame portion 22, and three connection portions 23. The vibration plate 15 has a plurality of openings 37 that are surrounded by the circular plate portion 21, the frame portion 22, and the connection portions 23. The plurality of openings 37 form a part of the pump chamber 6 (refer to FIG. 5). The circular plate portion 21 has a circular shape in a plan view. The frame portion 22 has a frame-like shape in which a circular opening is provided in a plan view and the frame portion 22 surrounds the periphery of the circular plate portion 21 with a gap interposed therebetween. The connection portions 23 connect the circular plate portion 21 and the frame portion 22 to each other. The circular plate portion 21 is supported by the connection portions 23 in a suspended state inside the pump chamber 6 (refer to FIG. 5).

The piezoelectric element 16, which is a first piezoelectric body (or a second piezoelectric body) is formed by providing electrodes on an upper surface and a lower surface of a circular plate composed of a piezoelectric material. The electrode on the upper surface of the piezoelectric element 16 is electrically connected to the external connection terminal 4A via the power feeding plate 18. The electrode on the lower surface of the piezoelectric element 16 is electrically connected to the external connection terminal 3A via the vibration plate 15 and the counter plate 13.

The piezoelectric element 16 and the circular plate portion 21 are affixed to each other via an adhesive or the like, which is not illustrated, thereby forming a vibration unit 24. The vibration unit 24 has a unimorph structure consisting of the piezoelectric element 16 and the circular plate portion 21, and is configured such that a vertical direction bending vibration is generated as a result of the expansion and contraction of the piezoelectric element 16 being confined to the circular plate portion 21.

The insulating plate 17 has a frame-like shape having a circular opening 38 in a plan view. The opening 38 forms a part of the pump chamber 6 (refer to FIG. 5). The insulating plate 17 is composed of an insulating resin and electrically insulates the power feeding plate 18 and the vibration plate 15 from each other.

The power feeding plate 18 is composed of a metal. The power feeding plate 18 is provided with the external connection terminal 4A and an internal connection terminal 27, and has an opening 39 that is surrounded by a support portion 29. The internal connection terminal 27 contacts the electrode on the upper surface of the piezoelectric element 16.

The outer wall 2C is plate shaped and covers the upper surface of the pump chamber 6 (refer to FIG. 5). The outer wall 2C has the first discharge hole 41. The first discharge hole 41 communicates with the pump chamber 6.

In the above-described first pump 110, when an alternating-current driving signal is applied to the external connection terminals 3A and 4A, an alternating electric field is applied in the thickness direction of the piezoelectric element 16. As a result, the piezoelectric element 16 expands and contracts in in-plane directions and the vibration unit 24 undergoes the concentric circular bending vibration.

Thus, a negative pressure is generated at a peripheral edge of the flow passage hole 132 inside the pump chamber 6, gas is sucked from the first suction holes 31 into the pump chamber 6, and the gas in the pump chamber 6 is discharged from the first discharge hole 41 to outside the pump chamber 6.

Although the illustration of first nozzles 35 is omitted from FIGS. 5 and 6, the first nozzles 35 may be fitted into the first suction holes 31.

Next, the flow of the air that occurs when the first pump 110 and the second pump 120 are discharging air will be explained.

Figure 7:
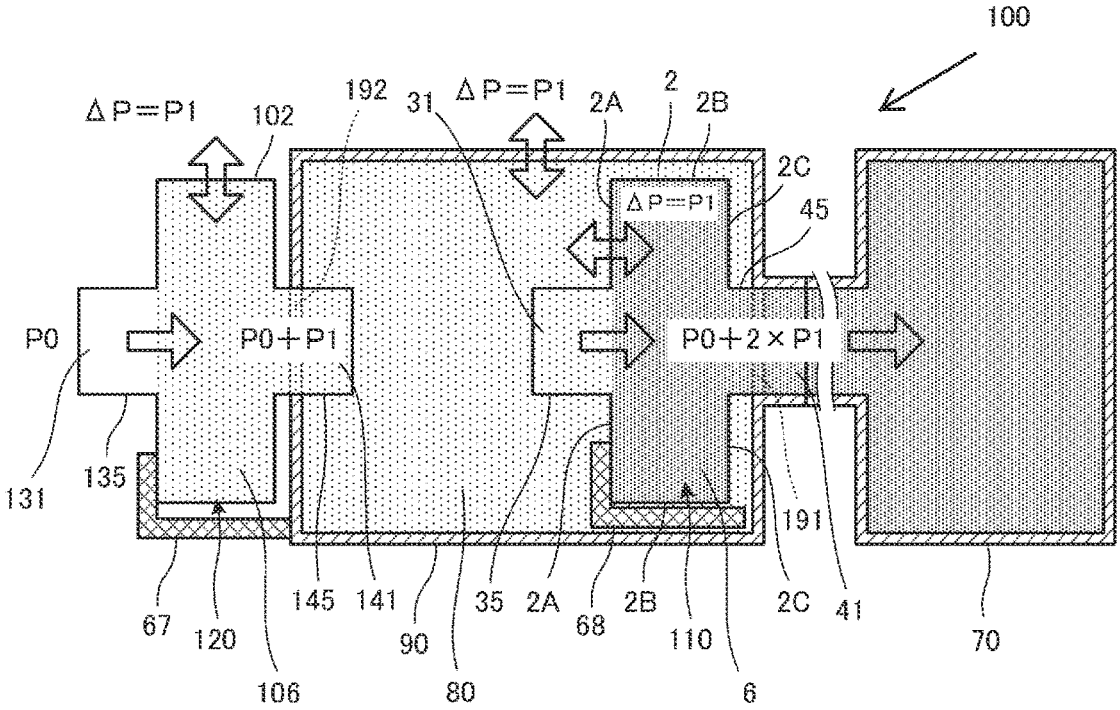
FIG. 7 is a schematic sectional view of the gas control device 100 during the first pump 110 and a second pump 120 illustrated in FIG. 1 are discharging air.

FIG. 7 is a schematic sectional view of the gas control device 100 during the first pump 110 and a second pump 120 illustrated in FIG. 1 are discharging air. The unidirectional arrows in FIG. 7 represent the flow of the air. The bidirectional arrows in FIG. 7 represent the pressure differences. The density of the hatching in FIG. 7 represents the magnitude of the pressure.

When the first pump 110 and the second pump 120 are discharging air, the air is sucked from the second suction hole 131 of the second pump 120 and flows into the first closed space 80 from the second discharge hole 141 of the second pump 120. Then, the air is sucked from the first suction hole 31 of the first pump 110 and flows into the container 70 from the first discharge hole 41 of the first pump 110. Consequently, the pressure inside the container 70 increases.

As described above, the maximum discharge flow rate produced by the two serially connected first pump 110 and second pump 120 is the same as the maximum discharge flow rate produced by the one first pump 110. On the other hand, as illustrated in FIG. 7, since the first pump 110 and the second pump 120 each produce a discharge pressure P1, the maximum discharge pressure produced by the two serially connected first pump 110 and second pump 120 is 2× P1.

Figure 22:
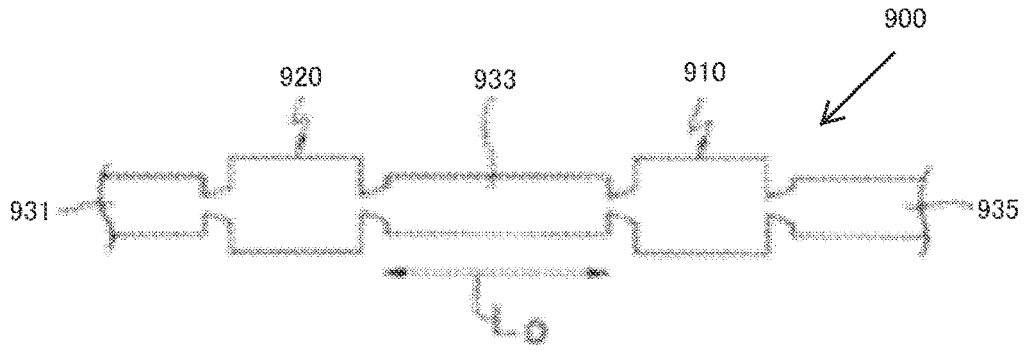
FIG. 22 is a plan view of a fluid transporting system 900 disclosed in Patent Document 1.
Figure 23:
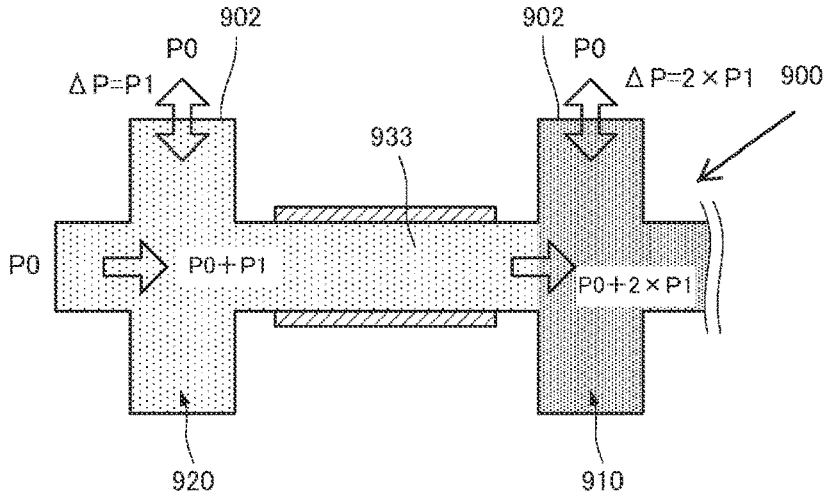
FIG. 23 is a sectional view illustrating a situation in which the fluid transporting system 900 illustrated in FIG. 22 is discharging air.

In this case, as described above, in the case where a plurality of pumps are connected in series with each other, the difference between the pressure inside a pump casing and the outside pressure is increased in the pump that is connected on the low-stage side close to the container. For example, as illustrated in FIG. 22 or 23, a pressure difference ΔP between a pressure P1+P0 inside a pump casing of the pump 920 on the high-stage side and an outside pressure P0 (atmospheric pressure) is equal to P1, whereas a pressure difference ΔP between a pressure 2× P1+P0 inside a pump casing of the pump 910 on the low-stage side close to the container 70 and the outside pressure P0 (atmospheric pressure) is equal to 2× P1.

However, in the gas control device 100, the first pump 110 and the second pump 120 are connected in series with each other by the connection casing 90. In addition, at least the outer wall 2A among the plurality of outer walls 2A, 2B, and 2C faces the first closed space 80.

Consequently, a pressure difference ΔP between a pressure P1+P0 inside the connection casing 90 and the outside pressure P0 (atmospheric pressure) is equal to P1. Then, a pressure difference ΔP between a pressure 2× P1+P0 on the inner side of the outer wall 2A of the first pump casing 2 in the first pump 110 in the lowest stage and an outside pressure P1+P0 is equal to P1. In addition, a pressure difference ΔP between a pressure P1+P0 inside the second pump casing 102 of the second pump 120 and an outside pressure P0 is equal to P1.

Therefore, the gas control device 100 is able to suppress a pressure difference AP between the pressure inside the first pump casing 2 of the first pump 110 in the lowest stage and the outside pressure so as to be less than or equal to the discharge pressure P1 of the first pump 110.

Therefore, the gas control device 100 is able to prevent the first pump 110 that is connected on a low-stage side from becoming damaged even in the case where a plurality of pumps are connected in series with each other. In addition, there is no need to increase the thickness of the first pump casing 2 in order to increase the pressure resistance of the first pump casing 2 in the gas control device 100. Therefore, there is no need to increase the size or weight of the first pump 110 in the gas control device 100.

In addition, in the gas control device 100, the outer walls 2B and 2C, other than the outer wall 2A, among the plurality of outer walls 2A, 2B, and 2C face the first closed space 80. Therefore, the gas control device 100 is able to better prevent the first pump 110 that is connected on a low-stage side from becoming damaged even in the case where a plurality of pumps are connected in series with each other.

In addition, a pressure difference ΔP between a pressure P1+P0 inside the second nozzle 145 and an outside pressure P1+P0 is 0. Therefore, in the gas control device 100, it is unlikely that the air inside the connection casing 90 will flow from the gap between the second nozzle 145 and the second pump casing 102 to outside the second pump casing 102.

Hereafter, a gas control device according to a second embodiment of the present disclosure will be described.

Figure 8:
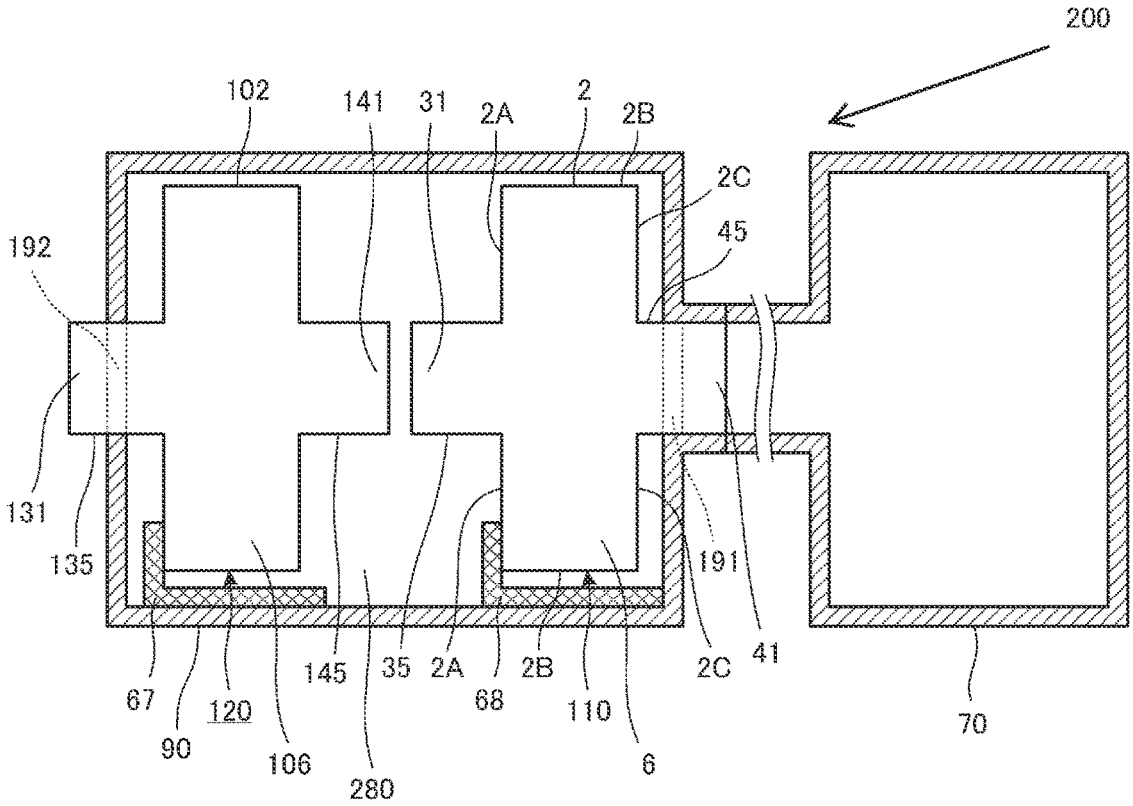
FIG. 8 is a schematic sectional view of a gas control device 200 according to a second embodiment of the present disclosure.
Figure 9:
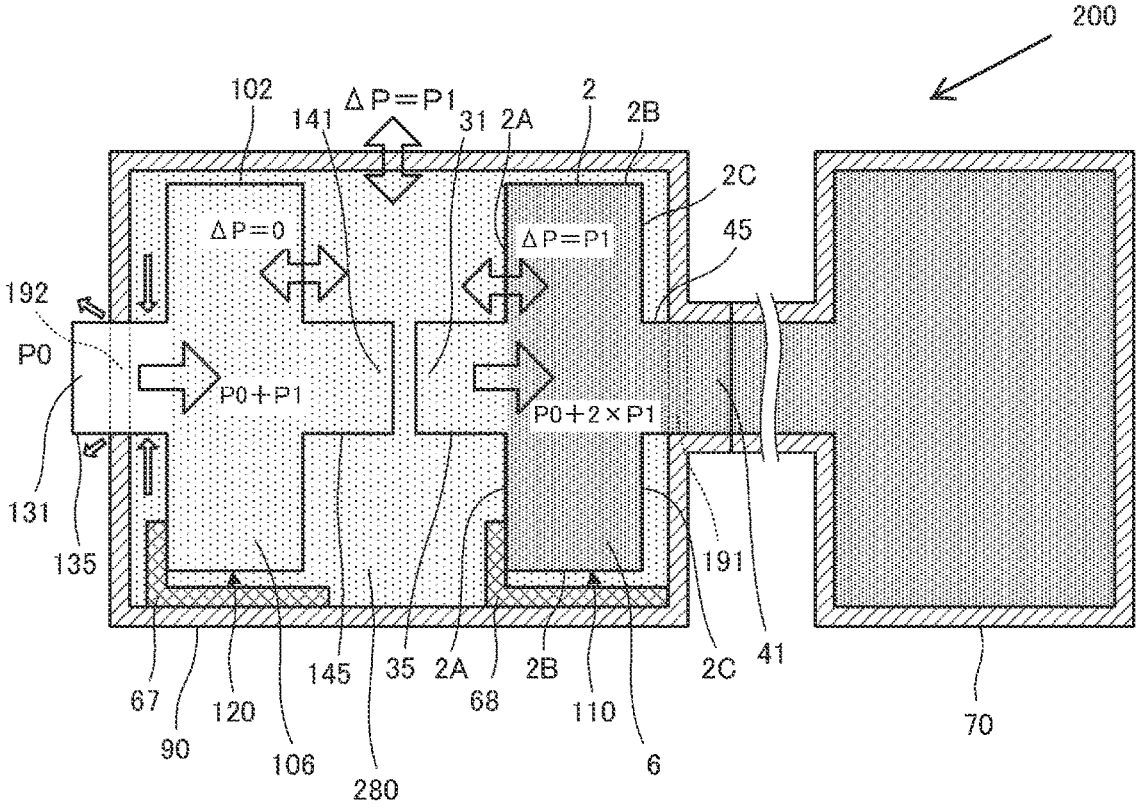
FIG. 9 is a schematic sectional view of the gas control device 200 during a first pump 110 and a second pump 120 illustrated in FIG. 8 are discharging air.

FIG. 8 is a schematic sectional view of a gas control device 200 according to the second embodiment of the present disclosure. FIG. 9 is a schematic sectional view of the gas control device 200 during a first pump 110 and a second pump 120 illustrated in FIG. 8 are discharging air. The unidirectional arrows in FIG. 9 represent the flow of the air. The bidirectional arrows in FIG. 9 represent the pressure differences. The density of the hatching in FIG. 9 represents the magnitude of the pressure.

The gas control device 200 differs from the gas control device 100 illustrated in FIG. 1 in that the second pump 120 and the wiring line 67 are arranged inside the connection casing 90. The second nozzle 135 is fitted into the second opening 192 of the connection casing 90 and the second pump casing 102 is thereby fixed in place by the connection casing 90. The rest of the configuration is identical and therefore the description thereof is omitted.

In the gas control device 200, the connection casing 90 forms a first closed space 280 together with the first pump casing 2 and the second pump casing 102. The second discharge hole 141 and the first suction hole 31 communicate with each other via the first closed space 280.

As described above, in the gas control device 200, the first pump 110 and the second pump 120 are connected in series with each other by the connection casing 90. Furthermore, regarding the first pump 110, the part of the first pump casing 2 other than the first nozzle 45 faces the first closed space 280.

In other words, at least the outer wall 2A among the plurality of outer walls 2A, 2B, and 2C faces the first closed space 280. In addition, the outer walls 2B and 2C, other than the outer wall 2A, among the plurality of outer walls 2A, 2B, and 2C also face the first closed space 280.

Consequently, a pressure difference ΔP between a pressure P1+P0 inside the connection casing 90 and the outside pressure P0 (atmospheric pressure) is equal to P1. Furthermore, a pressure difference ΔP between a pressure 2× P1+P0 on the inner sides of the outer walls 2A, 2B, and 2C of the first pump casing 2 of the first pump 110 in the lowest stage and an outside pressure P1+P0 is equal to P1. In addition, a pressure difference ΔP between a pressure P1+P0 inside the second pump casing 102 of the second pump 120 and an outside pressure P1+P0 is equal to 0.

Therefore, the gas control device 200 is able to suppress a pressure difference ΔP between the pressure inside the first pump casing 2 of the first pump 110 in the lowest stage and the outside pressure so as to be less than or equal to the discharge pressure P1 of the first pump 110.

Therefore, similarly to the gas control device 100, the gas control device 200 is able to prevent the first pump 110 that is connected on a low-stage side from becoming damaged even in the case where a plurality of pumps are connected in series with each other. In addition, similarly to as in the gas control device 100, there is no need to increase the size or weight of the first pump 110 in the gas control device 200.

In addition, the gas control device 200 includes the wiring line 67 inside the connection casing 90. Therefore, compared with the gas control device 100, the possibility of a line breakage occurring can be reduced and the reliability can be improved in the gas control device 200.

However, as illustrated in FIG. 9, a pressure difference ΔP between a pressure P0 inside the second nozzle 135 and an outside pressure P1 is equal to P1. Therefore, compared with the gas control device 100, in the gas control device 200, the air inside the connection casing 90 will more easily flow from the gap between the second nozzle 135 and the second pump casing 102 to outside the second pump casing 102.

Hereafter, a gas control device according to a third embodiment of the present disclosure will be described.

Figure 10:
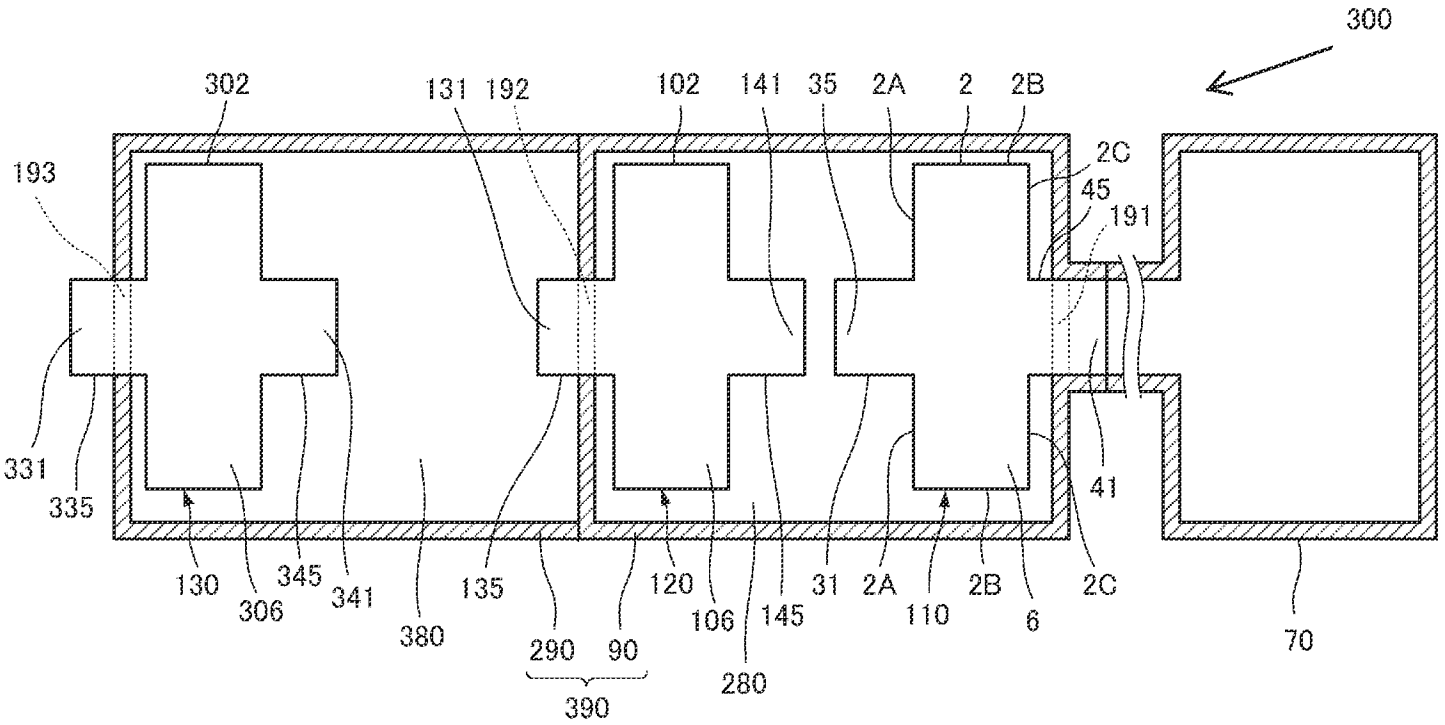
FIG. 10 is a schematic sectional view of a gas control device 300 according to a third embodiment of the present disclosure.
Figure 11:
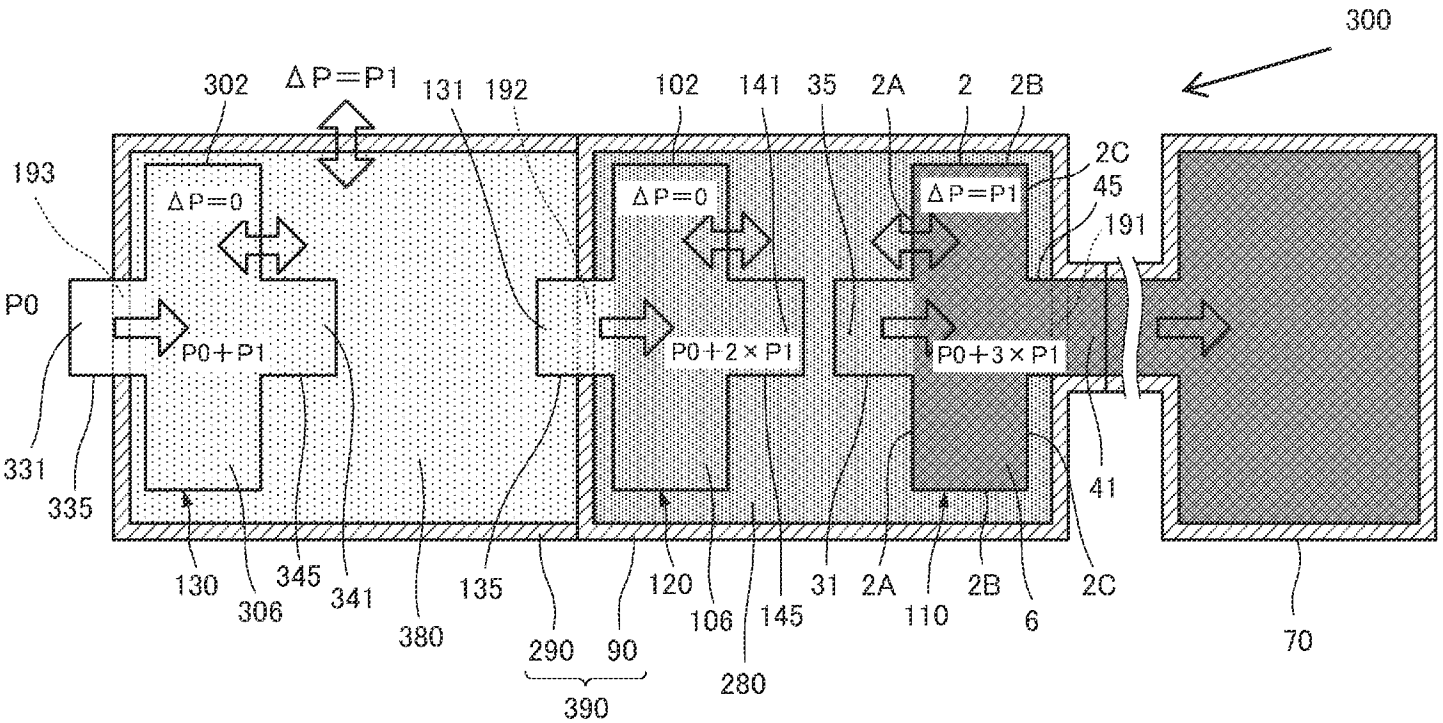
FIG. 11 is a schematic sectional view of the gas control device 300 during a first pump 110, a second pump 120, and a third pump 130 illustrated in FIG. 10 are discharging air.

FIG. 10 is a schematic sectional view of a gas control device 300 according to the third embodiment of the present disclosure. FIG. 11 is a schematic sectional view of the gas control device 300 during a first pump 110, a second pump 120, and a third pump 130 illustrated in FIG. 10 are discharging air. The unidirectional arrows in FIG. 11 represent the flow of the air. The bidirectional arrows in FIG. 11 represent the pressure differences. The density of the hatching in FIG. 11 represents the magnitude of the pressure. In addition, the illustration of wiring lines is omitted from FIGS. 10 and 11.

The gas control device 300 differs from the gas control device 100 illustrated in FIG. 1 in that the gas control device 300 includes the third pump 130 and a connection casing 390. The rest of the configuration is identical and therefore the description thereof is omitted.

The third pump 130 has a third pump casing 302, a third suction hole 331 and a third discharge hole 341 provided in the third pump casing 302, a third nozzle 345 inside of which the third discharge hole 341 is formed, and a third nozzle 335 inside of which the third suction hole 331 is formed. The configuration of the third pump 130 in this embodiment is the same as the configuration of the first pump 110 and therefore the description thereof is omitted.

The shape of the connection casing 390 is different from that of the connection casing 90. The connection casing 390 is formed by joining a connection casing 290, in which a third opening 193 is formed, and the connection casing 90 to each other. Thus, the connection casing 390 has the third opening 193.

In addition, the third nozzle 335 is fitted into the third opening 193 of the connection casing 390 and the third pump casing 302 is thereby fixed in place by the connection casing 390. Thus, the connection casing 390 contacts the third pump 130 only at the third nozzle 335. Therefore, the connection casing 390 does not obstruct the vibration of the third pump 130. Therefore, the gas control device 300 can maintain the characteristics of the third pump 130.

The connection casing 390 forms the first closed space 280 and a second closed space 380 together with the first pump casing 2, the second pump casing 102, and the third pump casing 302. The second discharge hole 141 and the first suction hole 31 communicate with each other via the first closed space 280. The third discharge hole 341 and the second suction hole 131 communicate with each other via the second closed space 380. The third suction hole 331 is open to the atmosphere. The rest of the configuration is identical and therefore the description thereof is omitted.

As described above, the maximum discharge flow rate produced by the three serially connected first pump 110, second pump 120, and third pump 130 is the same as the maximum discharge flow rate produced by one first pump 110. On the other hand, as illustrated in FIG. 11, since the first pump 110, the second pump 120, and the third pump 130 each produce a discharge pressure P1, the maximum discharge pressure produced by the three serially connected first pump 110, second pump 120, and third pump 130 is 3× P1.

However, in the gas control device 300, the first pump 110, the second pump 120, and the third pump 130 are connected in series with each other by the connection casing 390. Furthermore, regarding the first pump 110, the part of the first pump casing 2 other than the first nozzle 45 faces the first closed space 280.

In other words, at least the outer wall 2A among the plurality of outer walls 2A, 2B, and 2C faces the first closed space 280. In addition, the outer walls 2B and 2C, other than the outer wall 2A, among the plurality of outer walls 2A, 2B, and 2C also face the first closed space 280.

Therefore, a pressure difference AP between a pressure 3× P1+P0 on the inner sides of the outer walls 2A, 2B, and 2C of the first pump casing 2 in the first pump 110 in the lowest stage and an outside pressure 2× P1+P0 is equal to P1. In addition, a pressure difference ΔP between a pressure 2× P1+P0 inside the second pump casing 102 of the second pump 120 and an outside pressure 2×P1+P0 is equal to 0. Furthermore, a pressure difference ΔP between a pressure P1+P0 inside the third pump casing 302 of the third pump 130 and an outside pressure P1+P0 is equal to 0.

Therefore, the gas control device 300 is able to suppress a pressure difference ΔP between the pressure inside the first pump casing 2 of the first pump 110 in the lowest stage and the outside pressure so as to be less than or equal to the discharge pressure P1 of the first pump 110.

Therefore, similarly to the gas control device 100, the gas control device 300 is able to prevent the first pump 110 that is connected on a low-stage side from becoming damaged even in the case where a plurality of pumps are connected in series with each other. In addition, similarly to as in the gas control device 100, there is no need to increase the size or weight of the first pump 110 in the gas control device 300.

Furthermore, the connection casing 390 is formed of the connection casing 290 and the connection casing 90. Therefore, the gas control device 300 is manufactured by installing the first pump 110 and the second pump 120 in the connecting casing 90, in which wiring lines are provided, installing the third pump 130 in the connection casing 290, in which wiring lines are provided, and joining the connection casing 90 and the connection casing 290 together. Therefore, in the gas control device 300, the first pump 110, the second pump 120, and the third pump 130 can be easily connected in series with each other by the connection casing 390.

Hereafter, a gas control device according to a fourth embodiment of the present disclosure will be described.

Figure 12:
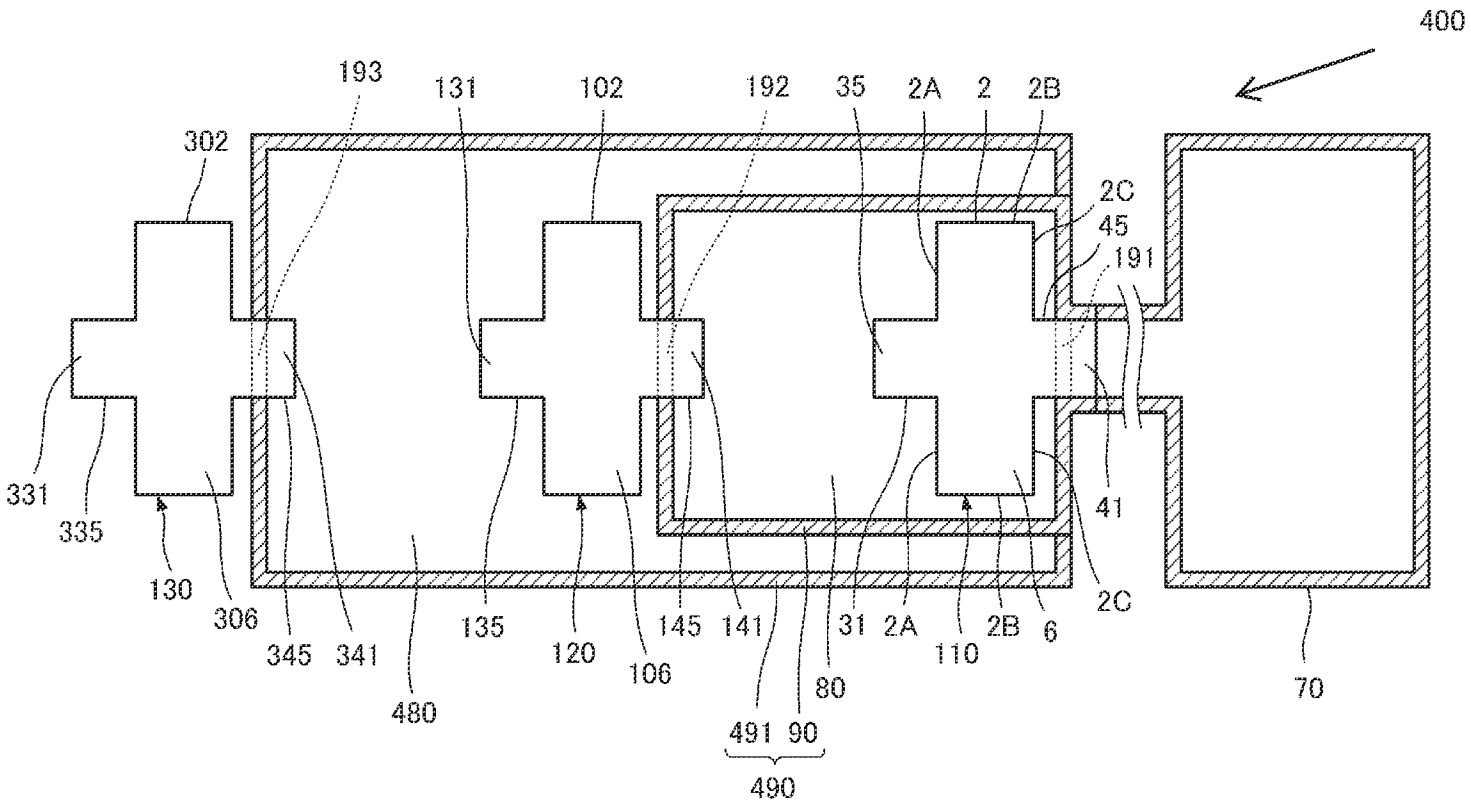
FIG. 12 is a schematic sectional view of a gas control device 400 according to a fourth embodiment of the present disclosure.
Figure 13:
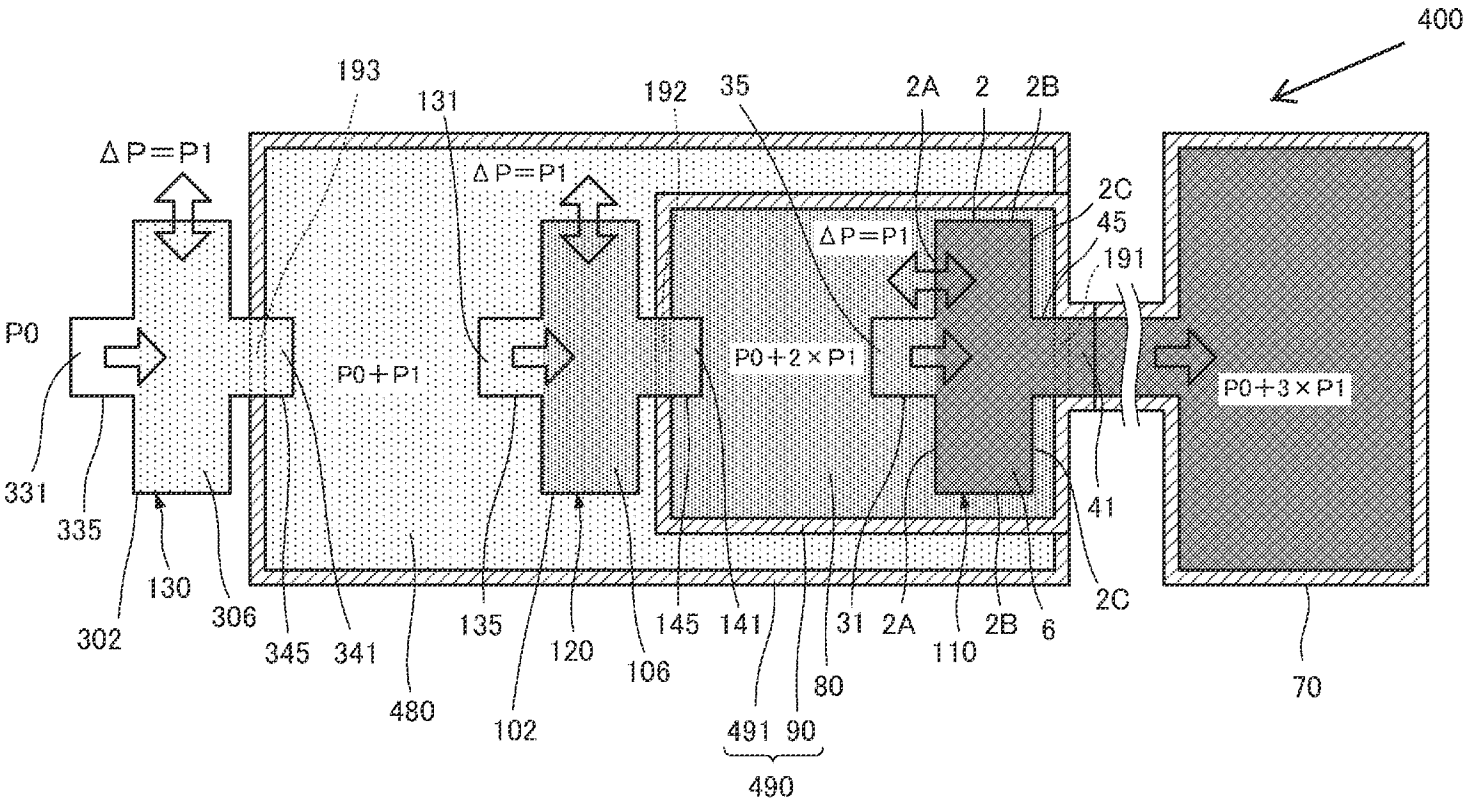
FIG. 13 is a schematic sectional view of the gas control device 400 during a first pump 110, a second pump 120, and a third pump 130 illustrated in FIG. 12 are discharging air.

FIG. 12 is a schematic sectional view of a gas control device 400 according to the fourth embodiment of the present disclosure. FIG. 13 is a schematic sectional view of the gas control device 400 during a first pump 110, a second pump 120, and a third pump 130 illustrated in FIG. 12 are discharging air. The unidirectional arrows in FIG. 13 represent the flow of the air. The bidirectional arrows in FIG. 13 represent the pressure differences. The density of the hatching in FIG. 13 represents the magnitude of the pressure. In addition, the illustration of wiring lines is omitted from FIGS. 12 and 13.

The gas control device 400 differs from the gas control device 300 illustrated in FIG. 10 in terms of the arrangement of the second pump 120 and the third pump 130 and the shape of a connection casing 490. The rest of the configuration is identical and therefore the description thereof is omitted.

The shape of the connection casing 490 is different from that of the connection casing 90. The connection casing 490 is formed by joining a connection casing 491, in which a third opening 193 is formed, and the connection casing 90 to each other. Thus, the connection casing 490 has the third opening 193.

The connection casing 490 forms a first closed space 80 and a second closed space 480 together with the first pump casing 2, the second pump casing 102, and the third pump casing 302. The second discharge hole 141 and the first suction hole 31 communicate with each other via the first closed space 80. In addition, the third discharge hole 341 and the second suction hole 131 communicate with each other via the second closed space 480.

As described above, in the gas control device 400, the first pump 110, the second pump 120, and the third pump 130 are connected in series with each other by the connection casing 490. Furthermore, regarding the first pump 110, the part of the first pump casing 2 other than the first nozzle 45 faces the first closed space 80.

In other words, at least the outer wall 2A among the plurality of outer walls 2A, 2B, and 2C faces the first closed space 80. In addition, the outer walls 2B and 2C, other than the outer wall 2A, among the plurality of outer walls 2A, 2B, and 2C also face the first closed space 80.

Therefore, a pressure difference ΔP between a pressure 3×P1+P0 on the inner sides of the outer walls 2A, 2B, and 2C of the first pump casing 2 in the first pump 110 in the lowest stage and an outside pressure 2×P1+P0 is equal to P1. In addition, a pressure difference ΔP between a pressure 2×P1+P0 inside the second pump casing 102 of the second pump 120 and an outside pressure P1+P0 is equal to P1. In addition, a pressure difference ΔP between a pressure P1+P0 inside the third pump casing 302 of the third pump 130 and an outside pressure P0 is equal to P1.

Therefore, the gas control device 400 is able to suppress a pressure difference ΔP between the pressure inside the first pump casing 2 of the first pump 110 in the lowest stage and the outside pressure so as to be less than or equal to the discharge pressure P1 of the first pump 110.

Therefore, similarly to the gas control device 100, the gas control device 400 is able to prevent the first pump 110 that is connected on a low-stage side from becoming damaged even in the case where a plurality of pumps are connected in series with each other. In addition, similarly to as in the gas control device 100, there is no need to increase the size or weight of the first pump 110 in the gas control device 400.

Furthermore, the connection casing 490 is formed of the connection casing 491 and the connection casing 90. Therefore, the gas control device 400 is manufactured by installing the first pump 110 and the second pump 120 in the connecting casing 90, in which wiring lines are provided, installing the third pump 130 in the connection casing 491, in which wiring lines are provided, and joining the connection casing 90 and the connection casing 491 together. Therefore, in the gas control device 400, the first pump 110, the second pump 120, and the third pump 130 can be easily connected in series with each other by the connection casing 490.

Hereafter, a gas control device according to a fifth embodiment of the present disclosure will be described.

Figure 14:
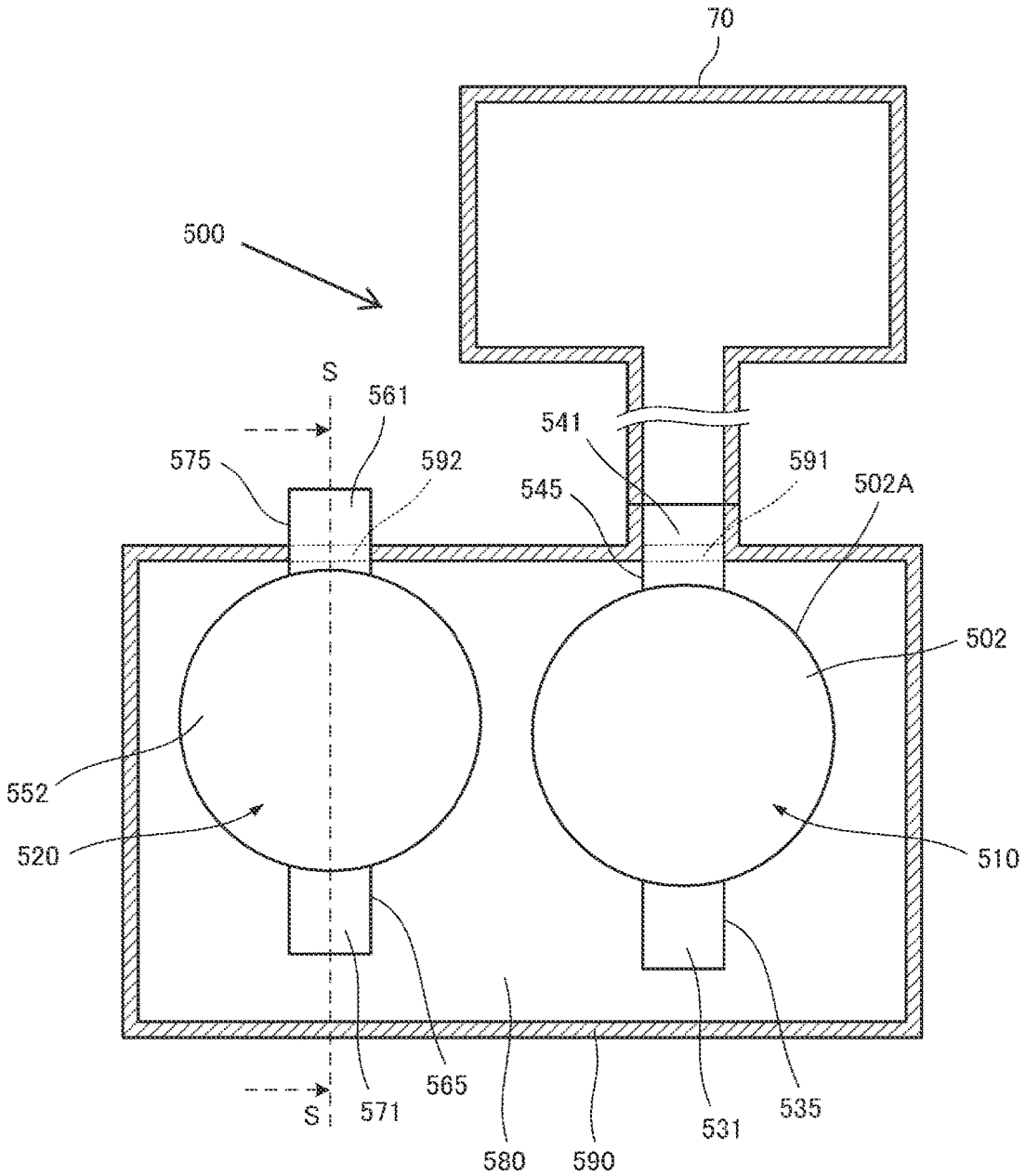
FIG. 14 is a schematic sectional view of a gas control device 500 according to a fifth embodiment of the present disclosure.
Figure 15:
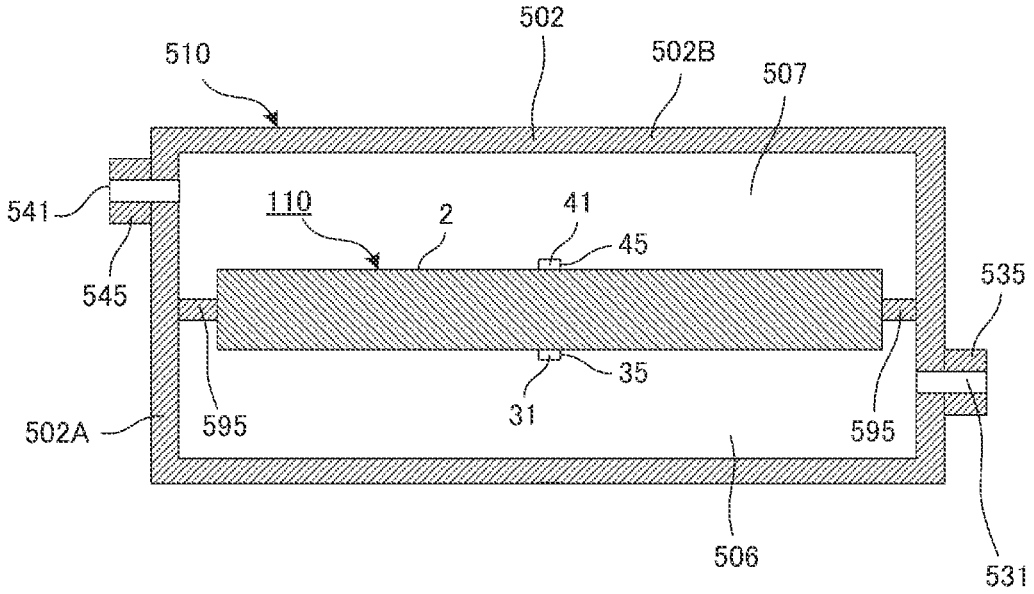
FIG. 15 is a sectional view taken along line S-S illustrated in FIG. 14.
Figure 16:
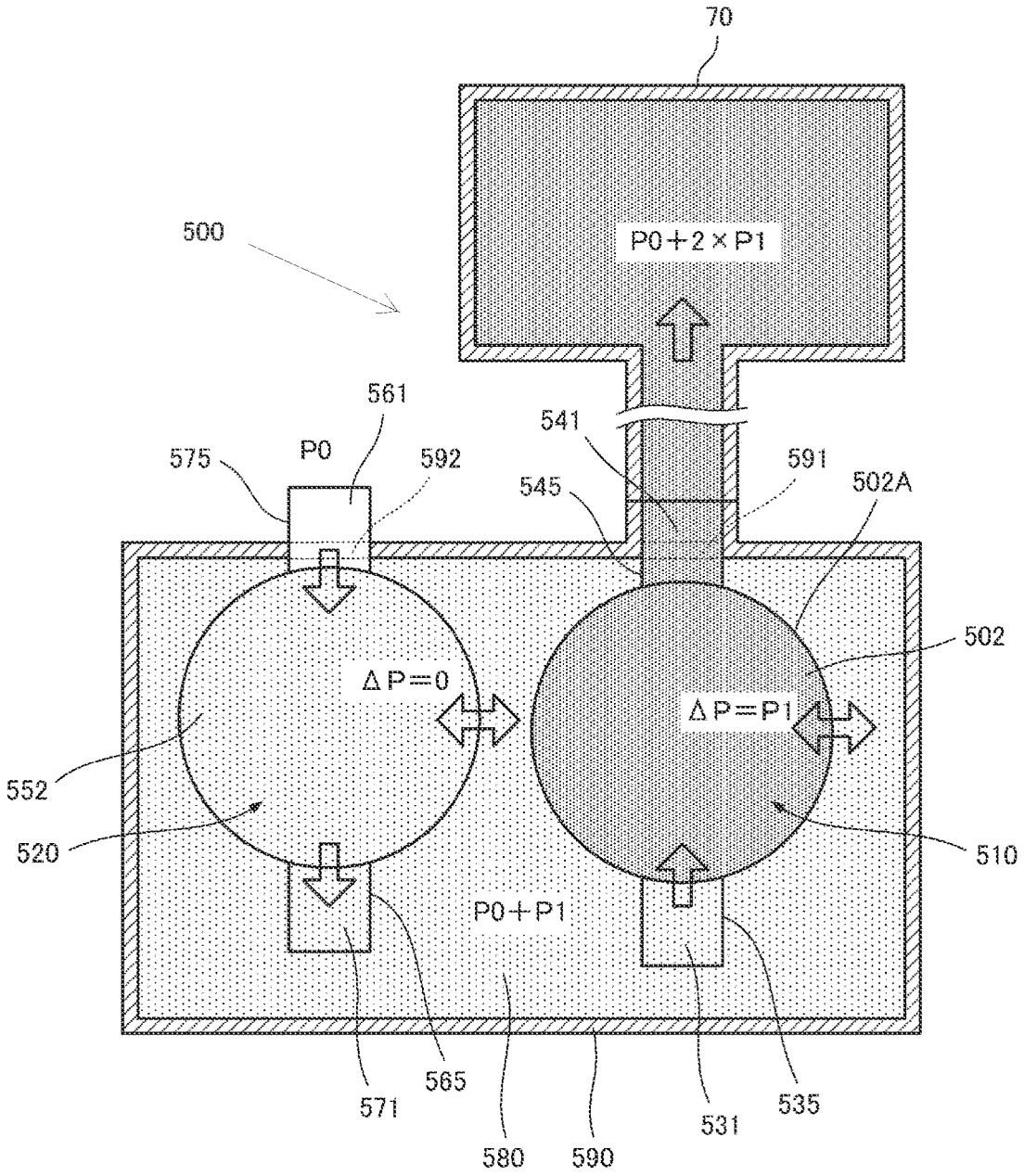
FIG. 16 is a schematic sectional view of the gas control device 500 during a first pump 510 and a second pump 520 illustrated in FIG. 14 are discharging air.

FIG. 14 is a schematic sectional view of a gas control device 500 according to the fifth embodiment of the present disclosure. FIG. 15 is a sectional view taken along line S-S illustrated in FIG. 14. FIG. 16 is a schematic sectional view of the gas control device 500 during a first pump 510 and a second pump 520 illustrated in FIG. 14 are discharging air. The unidirectional arrows in FIG. 16 represent the flow of the air. The bidirectional arrows in FIG. 16 represent the pressure differences. The density of the hatching in FIG. 16 represents the magnitude of the pressure.

The gas control device 500 differs from the gas control device 100 illustrated in FIG. 1 in terms of the shapes of the first pump 510, the second pump 520, and a connection casing 590.

As illustrated in FIGS. 14 and 15, the first pump 510 has a first pump 110, a first pump casing 502, a first suction hole 531 and a first discharge hole 541 provided in the first pump casing 502, a first nozzle 545 inside of which the first discharge hole 541 is formed, and a first nozzle 535 inside of which the first suction hole 531 is formed. The first pump casing 502 has a cylindrical shape and has a plurality of outer walls 502A and 502B. The outer wall 502A has the first suction hole 531.

The first pump casing 502 has fixing portions 595. The first pump casing 2 of the first pump 110 is fixed to the inside of the first pump casing 502 by the fixing portions 595. Thus, the first pump casing 502 forms, together with the first pump casing 2, a closed space 506, which communicates with the first suction hole 31 and the first suction hole 531, and a closed space 507, which communicates with the first discharge hole 41 and the first discharge hole 541.

The second pump 520 has a first pump 110, a second pump casing 552, a second suction hole 561 and a second discharge hole 561 provided in the second pump casing 552, a second nozzle 575 inside of which the second discharge hole 571 is formed, and a second nozzle 565 inside of which the second suction hole 571 is formed.

In this case, the configuration of the second pump 520 is the same as the configuration of the first pump 510. In other words, the configurations of the second pump casing 552, the second suction hole 561, the second discharge hole 571, the second nozzle 575, and the second nozzle 565 are the same as the configurations of the first pump casing 502, the first suction hole 531, the first discharge hole 541, the first nozzle 545, and the first nozzle 535, respectively.

The connection casing 590 has a first opening 591 and a second opening 592. The first nozzle 545 is fitted into the first opening 591 of the connection casing 590 and the first pump casing 502 is thereby fixed in place by the connection casing 590. Thus, the connection casing 590 contacts the first pump 110 only at the first nozzle 545. Therefore, the connection casing 590 does not obstruct the vibration of the first pump 110. Therefore, the gas control device 500 can maintain the characteristics of the first pump 110.

In addition, the second nozzle 575 is fitted into the second opening 592 of the connection casing 590 and the second pump casing 552 is thereby fixed in place by the connection casing 590. Thus, the connection casing 590 contacts the first pump 110 only at the second nozzle 575. Therefore, the connection casing 590 does not obstruct the vibration of the first pump 110. Therefore, the gas control device 500 can maintain the characteristics of the first pump 110.

The connection casing 590 forms a first closed space 580 together with the first pump casing 502 and the second pump casing 552. The second discharge hole 571 and the first suction hole 531 communicate with each other via the first closed space 580. In addition, the first discharge hole 541 communicates with the inside of the container 70. The second suction hole 561 is open to the atmosphere.

As described above, in the gas control device 500, the first pump 510 and the second pump 520 are connected in series with each other by the connection casing 590. Furthermore, regarding the first pump 510, the part of the first pump casing 502 other than the first nozzle 545 faces the first closed space 580.

Therefore, at least the outer wall 502A among the plurality of outer walls 502A, and 502B faces the first closed space 580. In addition, the outer wall 502B, other than the outer wall 502A, among the plurality of outer walls 502A and 502B also faces the first closed space 580.

Therefore, similarly to the gas control device 100, the gas control device 500 is able to prevent the first pump 510 that is connected on a low-stage side from becoming damaged even in the case where a plurality of pumps are connected in series with each other. In addition, similarly to as in the gas control device 100, there is no need to increase the size or weight of the first pump 510 in the gas control device 500.

Furthermore, there is no need for the first pump and the second pump to be equipped with nozzles. For example, valves may be used instead of nozzles as illustrated in FIG. 24.

Figure 24:
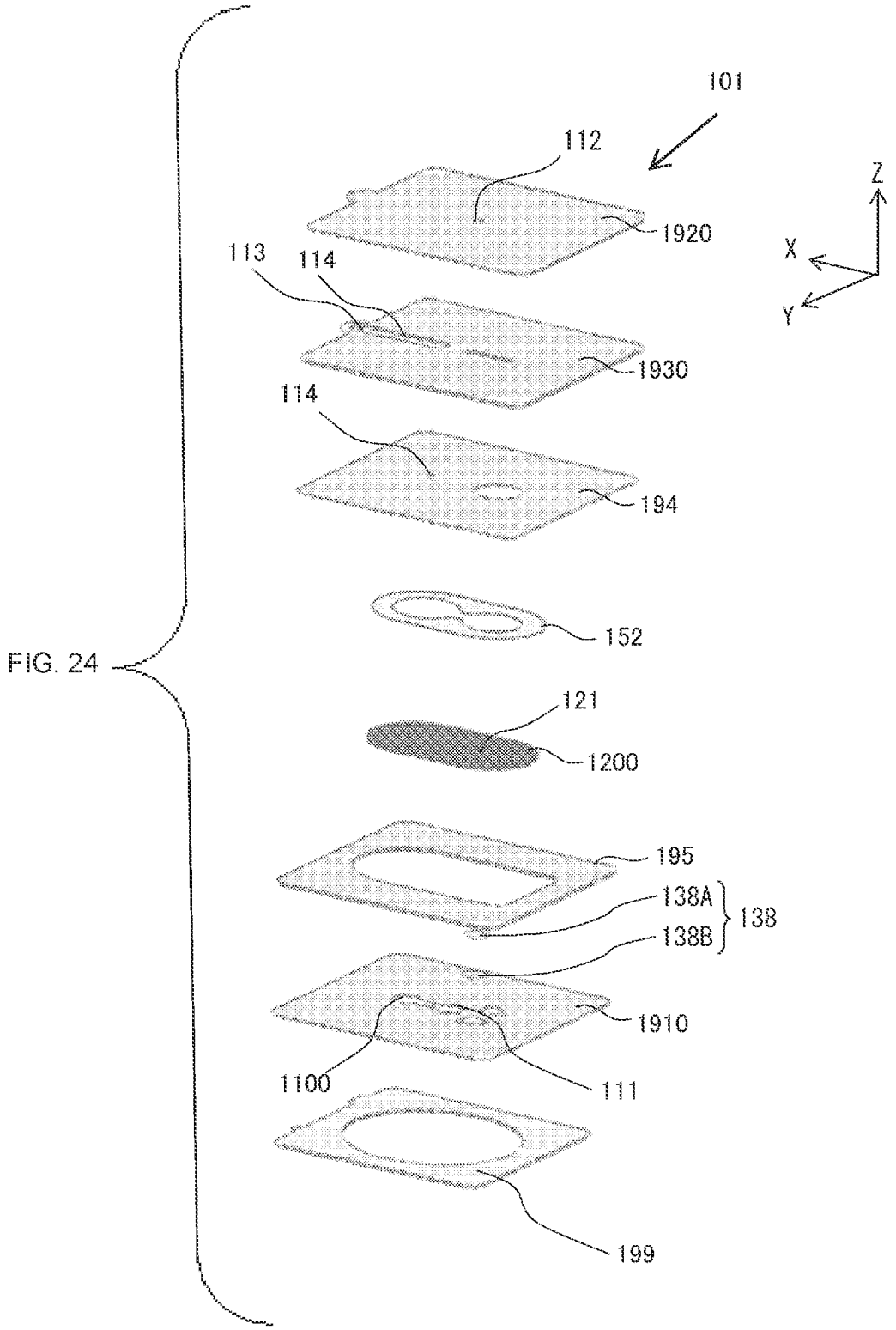
FIG. 24 is an exploded perspective view of a valve 101.

Next, FIG. 24 is an exploded perspective view of a valve 101. The valve 101 includes an isolation plate 199, a first plate 1910 in which a first air vent 1100 and a first air vent 111 are provided, a frame plate 195, a diaphragm 1200 composed of a rectangular thin film, a seal member 152 composed of a rectangular thin film, an intermediate plate 194, a flow passage forming plate 1930, and a second plate 1920 in which a second air vent 112 is provided, and the valve 101 has a structure in which these components are stacked in this order. The flow passage forming plate 1930, the intermediate plate 194, and the frame plate 195 form a side wall plate 190. The flow passage forming plate 1930 forms an exhaust flow passage 114 that communicates with an exhaust vent 113.

The material of the isolation plate 199 is a PET resin, for example. The material of the first plate 1910, the side wall plate 190, the second plate 1920 is a metal, for example. The second plate 1920, the flow passage forming plate 1930, the intermediate plate 194, the frame plate 195, and the first plate 1910 are joined to each other using a double-sided tape, thermal diffusion bonding or an adhesive, for example.

The second plate 1920 has a second air vent 112 that communicates with a cuff 109 and a valve seat 139 that is arranged along the periphery of the exhaust flow passage 114 that communicates with the exhaust vent 113. The second plate 1920 is composed of a resin, for example.

The first plate 1910 has the first air vent 1100 that communicates with a discharge hole 56 of a pump 10 and the first air vent 111 that communicates with a discharge hole 55 of the pump 10. The first plate 1910 is composed of a metal, for example.

A circular hole part 121 is provided in the center of a region of the diaphragm 1200 that faces a valve seat 138. The diameter of the hole part 121 is set so as to be smaller than the diameter of a surface of the valve seat 138 that contacts the diaphragm 1200. The outer periphery of the diaphragm 1200 is smaller than the outer peripheries of the first plate 1910 and the second plate 1920. The diaphragm 1200 is composed of an ethylene propylene diene rubber (EPDM) or silicone, for example.

The diaphragm 1200 is sandwiched between the first plate 1910 and the intermediate plate 194 with the seal member 152 interposed therebetween. Thus, a part of the diaphragm 1200 contacts the valve seat 139, and the periphery of the hole part 121 in the diaphragm 1200 contacts the valve seat 138. The valve seat 138 is provided on the first plate 1910 so as to pressurize the periphery of the hole part 121 of the diaphragm 1200. The valve seat 138 consists of a protruding portion 138A and a protruding portion 138B. The material of the protruding portion 138A and the protruding portion 138B is a metal, for example.

The diaphragm 1200 divides a space formed by the second plate 1920 and the first plate 1910 into a first valve chamber and a second valve chamber. The diameters of the first valve chamber and the second valve chamber are 7.0 mm, for example. The diameter of a surface of the valve seat 138 that contacts the diaphragm 1200 is 1.5 mm, for example.

In the valve 101, a part of the seal member 152 is located in the second valve chamber. The seal member 152 is composed of a double-sided tape or an adhesive, for example.

A non-return valve is formed by the periphery of the hole part 121 in the diaphragm 1200 and the valve seat 138, which contacts the periphery of the hole part 121 and covers the hole part 121. In the non-return valve, the diaphragm 1200 contacts or separates from the valve seat 138 on the basis of the pressure of the first valve chamber and the pressure of the second valve chamber.

In addition, an exhaust valve 170 is formed of a part of the diaphragm 120 and the valve seat 139, which is located around the periphery of the exhaust flow passage 114. In the exhaust valve, a part of the diaphragm 1200 contacts or separates from the valve seat 139 on the basis of the pressure of the first valve chamber and the pressure of the second valve chamber.

Figure 25:
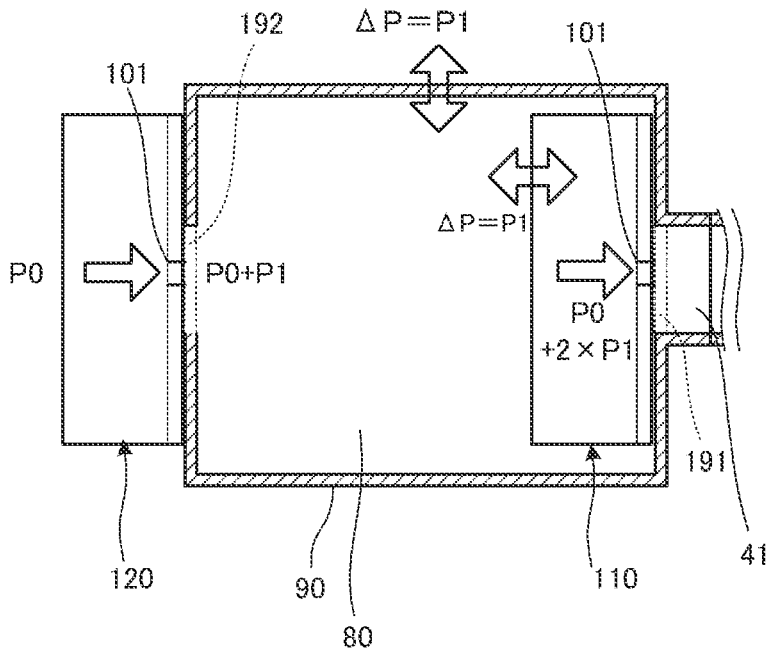
FIG. 25 is a schematic sectional view of a case in which a first pump and a second pump 120 of the valve 101 are discharging air.

As illustrated in FIG. 25, even in the case where a first pump and a second pump, which are each equipped with the valve 101 as described above instead of a nozzle, are used, a pressure difference $\Delta P$ between an internal pressure acting on a first outer wall of a first pump casing and the outside pressure can be suppressed to a discharge pressure P1 of the first pump.

Hereafter, a gas control device according to a sixth embodiment of the present disclosure will be described.

Figure 17:
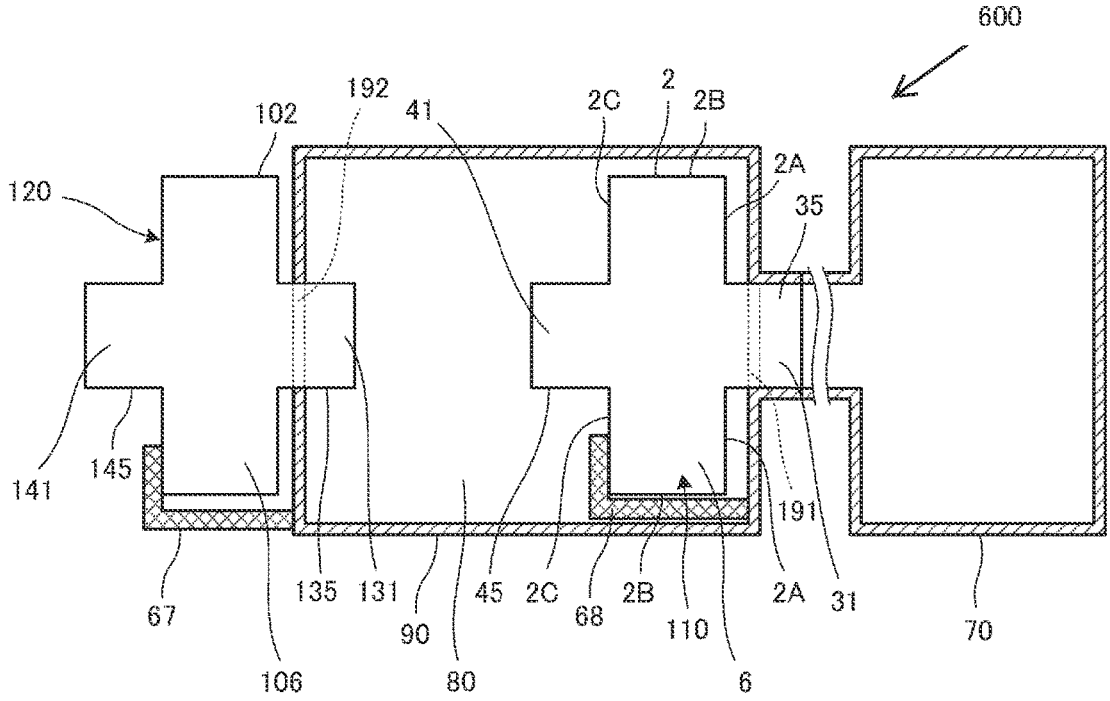
FIG. 17 is a schematic sectional view of a gas control device 600 according to a sixth embodiment of the present disclosure.

FIG. 17 is a schematic sectional view of a gas control device 600 according to the sixth embodiment of the present disclosure. The gas control device 600 differs from the gas control device 100 illustrated in FIG. 1 in that the first pump 110 and the second pump 120 are each fixed to the connection casing 90 with an orientation opposite to that in the gas control device 100. The first suction hole 31 is connected to the container 70 and communicates with the inside of the container 70. The first discharge hole 41 and the second suction hole 131 communicate with each other via the first closed space 80. The rest of the configuration is identical and therefore the description thereof is omitted.

In addition, in this embodiment, the outer wall 2C corresponds to an example of a first outer wall of the present disclosure, and the outer walls 2A and 2B correspond to the examples of the second outer walls of the present disclosure.

Next, the flow of the air that occurs when the first pump 110 and the second pump 120 are sucking air will be explained.

Figure 18:
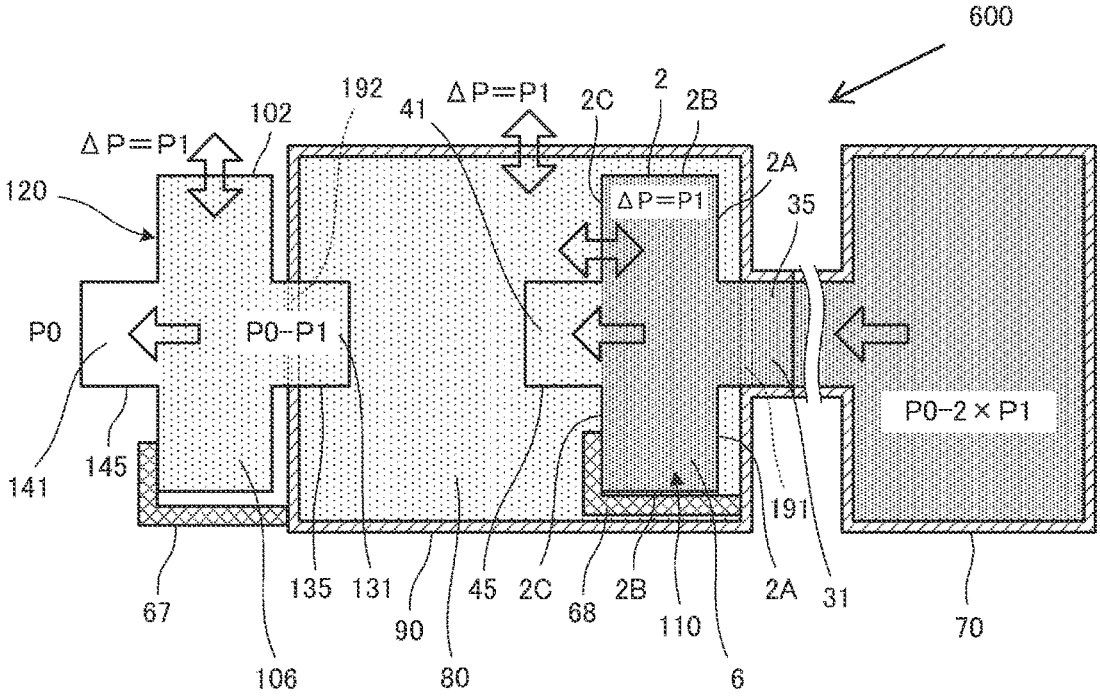
FIG. 18 is a schematic sectional view of the gas control device 600 during a first pump 110 and a second pump 120 illustrated in FIG. 17 are sucking air.

FIG. 18 is a schematic sectional view of the gas control device 600 during a first pump 110 and a second pump 120 illustrated in FIG. 17 are sucking air. The unidirectional arrows in FIG. 18 represent the flow of the air. The bidirectional arrows in FIG. 18 represent the pressure differences. The density of the hatching in FIG. 18 represents the magnitude of the pressure.

When the first pump 110 and the second pump 120 are sucking air, the air inside the container 70 is sucked from the first suction hole 31 of the first pump 110 and flows into the first closed space 80 from the first discharge hole 41 of the first pump 110. Then, the air in the first closed space 80 is sucked from the second suction hole 131 of the second pump 120 and flows from the second discharge hole 141 of the second pump 120 to outside the second pump casing 102. Consequently, the pressure inside the container 70 decreases.

As described above, the maximum suction flow rate produced by the two serially connected first pump 110 and second pump 120 is the same as the maximum suction flow rate produced by the one first pump 110. On the other hand, as illustrated in FIG. 18, since the first pump 110 and the second pump 120 each produce a suction pressure P1, the maximum suction pressure produced by the two serially connected first pump 110 and second pump 120 is 2×P1.

However, in the gas control device 600, the first pump 110 and the second pump 120 are connected in series with each other by the connection casing 90. Furthermore, regarding the first pump 110, the part of the first pump casing 2 other than the first nozzle 35 faces the first closed space 80.

In other words, at least the outer wall 2C among the plurality of outer walls 2A, 2B, and 2C faces the first closed space 80. In addition, the outer walls 2A and 2B, other than the outer wall 2C, among the plurality of outer walls 2A, 2B, and 2C also face the first closed space 80.

Consequently, a pressure difference ΔP between a pressure P0-P1 inside the connection casing 90 and the outside pressure P0 (atmospheric pressure) is equal to P1. In addition, a pressure difference AP between a pressure P0-P1 inside the second pump casing 102 of the second pump 120 and an outside pressure P0 is equal to P1. Then, a pressure difference ΔP between a pressure P0−2×P1 on the inner sides of the outer walls 2A, 2B, and 2C of the first pump casing 2 of the first pump 110 in the lowest stage and an outside pressure P0-P1 is equal to P1.

Therefore, the gas control device 600 is able to suppress a pressure difference ΔP between the pressure inside the first pump casing 2 of the first pump 110 in the lowest stage and the outside pressure so as to be less than or equal to the suction pressure P1 of the first pump 110.

Therefore, similarly to the gas control device 100, the gas control device 600 is able to prevent the first pump 110 that is connected on a low-stage side from becoming damaged even in the case where a plurality of pumps are connected in series with each other. In addition, similarly to as in the gas control device 100, there is no need to increase the size or weight of the first pump 110 in the gas control device 600.

As a modification of the gas control device 600, the second pump 120 may be arranged inside the connection casing 90 as in the gas control device 200 illustrated in FIG. 8.

Hereafter, a gas control device according to a seventh embodiment of the present disclosure will be described.

Figure 19:
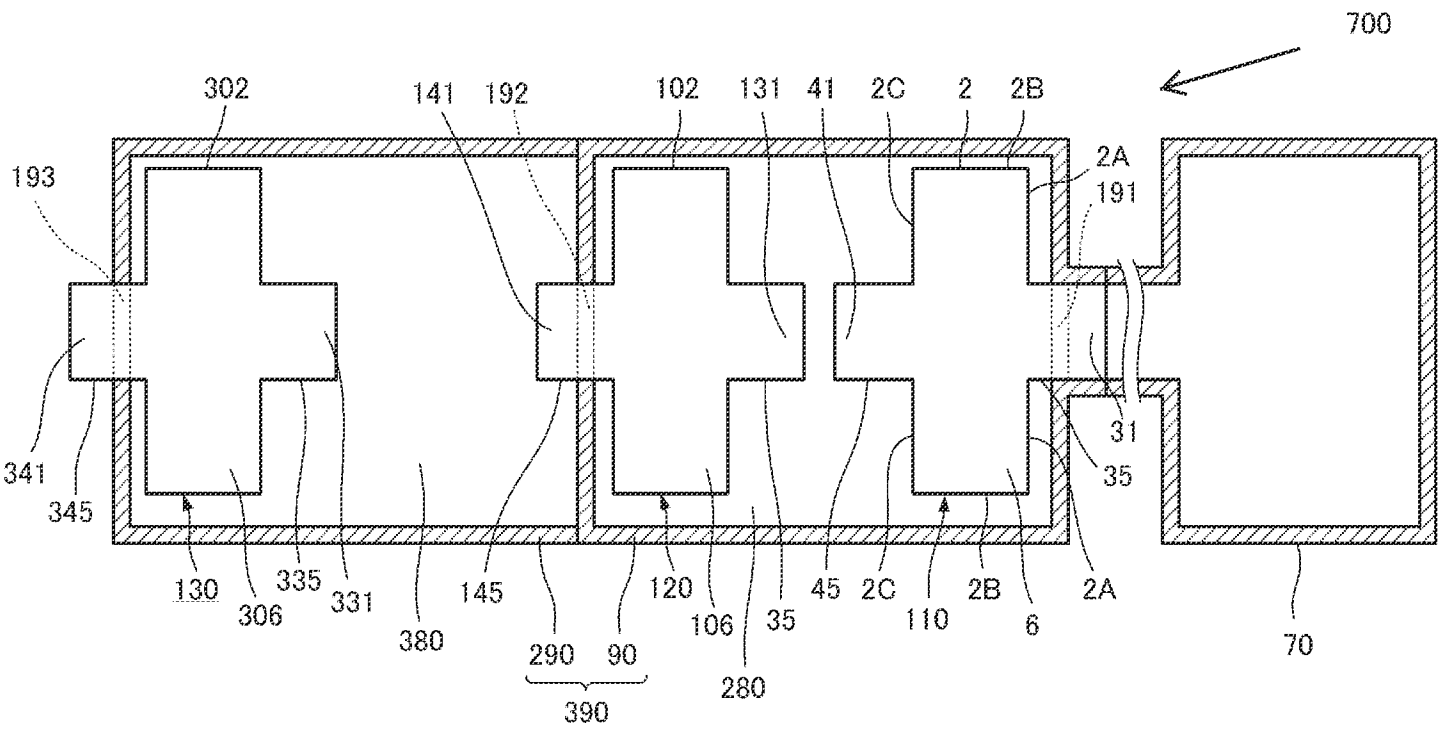
FIG. 19 is a schematic sectional view of a gas control device 700 according to a seventh embodiment of the present disclosure.

FIG. 19 is a schematic sectional view of a gas control device 700 according to the seventh embodiment of the present disclosure. The gas control device 700 differs from the gas control device 300 illustrated in FIG. 10 in that the first pump 110, the second pump 120, and the third pump 130 are each fixed to the connection casing 390 with an orientation opposite to that in the gas control device 300. The first suction hole 31 is connected to the container 70 and communicates with the inside of the container 70. The first discharge hole 41 and the second suction hole 131 communicate with each other via the first closed space 280. The second discharge hole 141 and the third suction hole 331 communicate with each other via the second closed space 380. The rest of the configuration is identical and therefore the description thereof is omitted.

In addition, in this embodiment, the outer wall 2C corresponds to an example of a first outer wall of the present disclosure, and the outer walls 2A and 2B correspond to the examples of the second outer walls of the present disclosure.

Next, the flow of the air that occurs when the first pump 110, the second pump 120, and the third pump 130 are sucking air will be explained.

Figure 20:
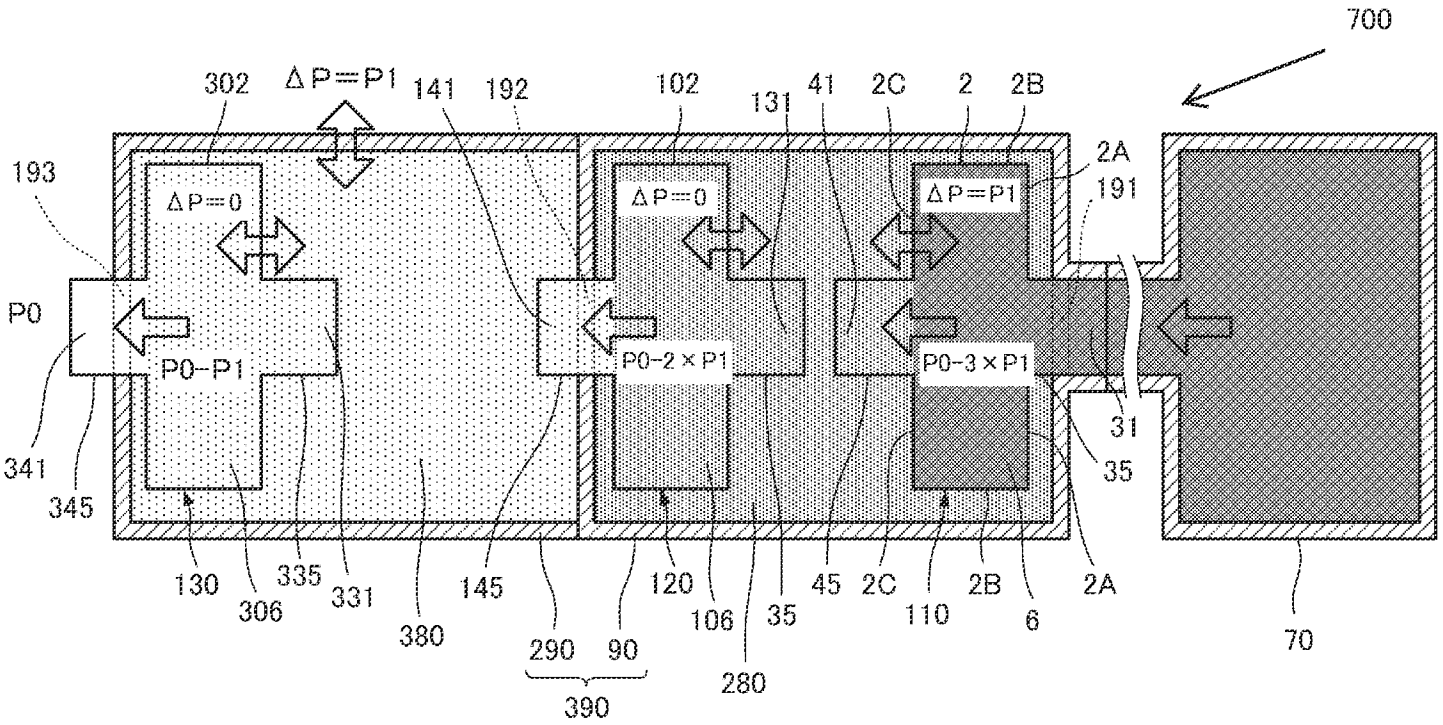
FIG. 20 is a schematic sectional view of the gas control device 700 during a first pump 110, a second pump 120, and a third pump 130 illustrated in FIG. 19 are sucking air.

FIG. 20 is a schematic sectional view of the gas control device 700 during the first pump 110, the second pump 120, and the third pump 130 illustrated in FIG. 19 are sucking air. The unidirectional arrows in FIG. 20 represent the flow of the air. The bidirectional arrows in FIG. 20 represent the pressure differences. The density of the hatching in FIG. 20 represents the magnitude of the pressure.

When the first pump 110, the second pump 120, and the third pump 130 are sucking air, the air inside the container 70 is sucked from the first suction hole 31 of the first pump 110 and flows into the first closed space 280 from the first discharge hole 41 of the first pump 110. Then, the air in the first closed space 280 is sucked from the second suction hole 131 of the second pump 120 and flows into the second closed space 380 from the second discharge hole 141 of the second pump 120. After that, the air in the second closed space 380 is sucked from the third suction hole 331 of the third pump 130 and flows from the third discharge hole 341 of the third pump 130 to outside the third pump casing 302. Consequently, the pressure inside the container 70 decreases.

As described above, the maximum suction flow rate produced by the three serially connected first pump 110, second pump 120, and third pump 130 is the same as the maximum suction flow rate produced by the one first pump 110. On the other hand, as illustrated in FIG. 20, since the first pump 110, the second pump 120, and the third pump 130 each produce a suction pressure P1, the maximum suction pressure produced by the three serially connected first pump 110, second pump 120, and third pump 130 is 3×P1.

However, in the gas control device 700, the first pump 110, the second pump 120, and the third pump 130 are connected in series with each other by the connection casing 390. Furthermore, regarding the first pump 110, the part of the first pump casing 2 other than the first nozzle 45 faces the first closed space 280.

In other words, at least the outer wall 2C, in which the first discharge hole 41 is provided, among the plurality of outer walls 2A, 2B, and 2C faces the first closed space 280. In addition, the outer walls 2A and 2B, other than the outer wall 2C, among the plurality of outer walls 2A, 2B, and 2C also face the first closed space 280.

Therefore, a pressure difference ΔP between a pressure P0−3×P1 on the inner sides of the outer walls 2A, 2B, and 2C of the first pump casing 2 in the first pump 110 in the lowest stage and an outside pressure P0−2×P1 is equal to P1. Furthermore, a pressure difference ΔP between a pressure P0−2×P1 inside the second pump casing 102 of the second pump 120 and an outside pressure P0−2×P1 is equal to 0. Furthermore, a pressure difference ΔP between a pressure P0−P1 inside the third pump casing 302 of the third pump 130 and an outside pressure P0−P1 is equal to 0.

Therefore, the gas control device 700 is able to suppress a pressure difference ΔP between the pressure inside the first pump casing 2 of the first pump 110 in the lowest stage and the outside pressure so as to be less than or equal to the suction pressure P1 of the first pump 110.

Therefore, similarly to the gas control device 100, the gas control device 700 is able to prevent the first pump 110 that is connected on a low-stage side from becoming damaged even in the case where a plurality of pumps are connected in series with each other. In addition, similarly to as in the gas control device 100, there is no need to increase the size or weight of the first pump 110 in the gas control device 700.

Hereafter, the relationship between the number of serially connected pumps and the pressure difference acting on the pump casing in the lowest stage will be described.

Figure 21:
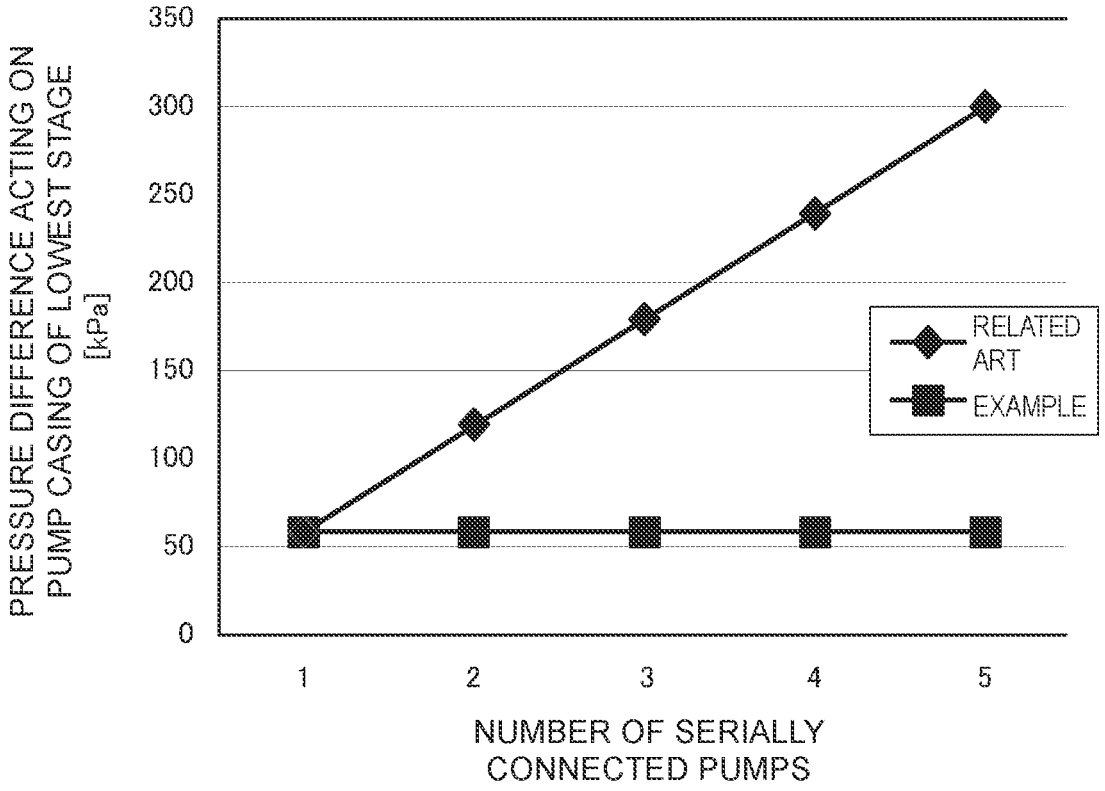
FIG. 21 is a diagram illustrating an example of a relationship between the number of serially connected pumps and a pressure difference acting on a pump casing in the lowest stage.

FIG. 21 is a diagram illustrating an example of a relationship between the number of serially connected pumps and the pressure difference acting on a pump casing in the lowest stage.

As described above, in the case where a plurality of pumps are connected in series with each other, the difference between the pressure inside the pump casing and the outside pressure is increased in the pump that is connected on a low-stage side close to a container. As illustrated in FIG. 21, the pressure difference acting on the pump casing in the lowest stage increases in proportion to the number of serially connected pumps.

However, the gas control devices 100 to 700 of these embodiments are able to suppress a pressure difference ΔP between the pressure inside the first pump casing 2 of the first pump 110 in the lowest stage and the outside pressure so as to be less than or equal to the discharge pressure P1 of the first pump 110 regardless of the number of serially connected pumps.

In addition, although an example has been described in which air is used as a gas in each of the above-described embodiments, the present disclosure is not limited to this example.

Finally, the descriptions of the above embodiments should be thought of as being illustrative in all points and not restrictive. The scope of the present disclosure is defined by the following claims rather than by the above-described embodiments. In addition, all modifications that are within the scope of equivalents of the scope of the claims are included within the scope of the present disclosure.

2 . . . first pump casing
2A, 2B, 2C . . . outer wall
3A, 4A . . . external connection terminal
5B . . . valve seat
6 . . . pump chamber
12 . . . flow passage plate
13 . . . counter plate
15 . . . vibration plate
16 . . . piezoelectric element
17 . . . insulating plate
18 . . . power feeding plate
21 . . . circular plate portion
32 . . . frame portion
23 . . . connection portion
24 . . . vibration unit
27 . . . internal connection terminal
31 . . . first suction hole
32 . . . opening
33 . . . flow passage
34, 36 . . . adhesive sealing hole
35 . . . first nozzle
37, 38, 39 . . . opening
41 . . . first discharge hole
45 . . . first nozzle
61, 62 . . . O ring
63 . . . packing
65, 66 . . . non-return valve
67, 68 . . . wiring line
70 . . . container
80, 280, 580 . . . first closed space
81 . . . closed space
85 . . . lid casing
89 . . . connection hole
90, 290, 390, 490, 491, 590 . . . connection casing
91 . . . first casing
92 . . . second casing
100, 200, 300, 400, 500, 600, 700 . . . gas control device
102 . . . second pump casing
110 . . . first pump
120 . . . second pump
130 . . . third pump
131 . . . second suction hole
132 . . . flow passage hole
135 . . . second nozzle
141 . . . second discharge hole
145 . . . second nozzle
165 . . . second nozzle
191 . . . first opening
192 . . . second opening
193 . . . third opening
302 . . . third pump casing
331 . . . third suction hole
335 . . . third nozzle
341 . . . third discharge hole
345 . . . third nozzle
380, 480 . . . second closed space
502 . . . first pump casing
502A, 502B . . . outer wall
506, 507 . . . closed space
510 . . . first pump
520 . . . second pump
531 . . . first suction hole
535 . . . first nozzle
541 . . . first discharge hole
545 . . . first nozzle
552 . . . second pump casing
561 . . . second suction hole
571 . . . second discharge hole
575 . . . second nozzle
591 . . . first opening
592 . . . second opening
595 . . . fixing portion
900 . . . fluid transporting system
902 . . . pump casing
910, 920 . . . pump
931, 933, 935 . . . flow passage

The invention claimed is:

1. A gas control device comprising:

a first pump including a first pump casing, a first suction hole and a first discharge hole, wherein the first pump casing has a plurality of outer walls, and the first suction hole and the first discharge hole are provided in the first pump casing;

a second pump including a second pump casing, a second suction hole and a second discharge hole, wherein the second suction hole and the second discharge hole are provided in the second pump casing;

a connection casing; and a first closed space defined as a space surrounded by the first pump casing, the second pump casing, and the connection casing, wherein the plurality of outer walls include at least a first outer wall, the first discharge hole is provided in the first outer wall, and the first outer wall faces the first closed space, wherein the plurality of outer walls further include a second outer wall that faces the first closed space, said second outer wall defining an outer periphery of the first pump casing, wherein the plurality of outer walls of the first pump casing are located within the connection casing, wherein the first discharge hole and the second suction hole communicate with each other via the first closed space, wherein the first and second outer walls face different, respective, directions, wherein the second pump casing includes a first nozzle and a second nozzle, and wherein the first closed space communicates with an area outside the second pump casing via only the first and second nozzles of the second pump casing and an area inside the second pump casing.

2. The gas control device according to claim 1, wherein the first pump casing has a first nozzle, and the first discharge hole or the first suction hole is provided inside the first nozzle of the first pump casing, wherein the connection casing has a first opening, and wherein the first nozzle of the first pump casing is fitted into the first opening of the connection casing, and the first pump casing is thereby fixed in place by the connection casing.

3. The gas control device according claim 1, wherein the first pump includes a first piezoelectric body and a first vibration plate, and the first vibration plate vibrates in response to expansion and contraction of the first piezoelectric body, and wherein the second pump includes a second piezoelectric body and a second vibration plate, and the second piezoelectric body vibrates in response to expansion and contraction of the second piezoelectric body.

4. The gas control device according to claim 1, further comprising: a third pump including a third pump casing, a third suction hole and a third discharge hole, wherein the third suction hole and the third discharge hole are provided in the third pump casing;

wherein the connection casing provides, together with the second pump casing and the third pump casing, a second closed space, and wherein the second pump casing faces the first closed space and the second closed space.

5. The gas control device according to claim 1, wherein the plurality of outer walls further include a third outer wall that faces the first closed space, said third outer wall facing a direction opposite to the first outer wall.

6. The gas control device according to claim 5, wherein the first pump casing has a first nozzle projecting outwards from the third outer wall, wherein the connection casing has a first opening, and wherein the first nozzle of the first pump casing is fitted into the first opening of the connection casing, and the first pump casing is thereby fixed in place by the connection casing.

* * * * *